US011001072B2

(12) United States Patent
Yamanaka et al.

(10) Patent No.: US 11,001,072 B2
(45) Date of Patent: May 11, 2021

(54) LIQUID DISCHARGE HEAD, LIQUID DISCHARGE DEVICE, DISPENSING DEVICE, AND LIQUID DISCHARGE METHOD

(71) Applicants: Manabu Yamanaka, Kanagawa (JP); Daisuke Takagi, Kanagawa (JP); Shinnosuke Koshizuka, Kanagawa (JP); Hiroshi Fujie, Kanagawa (JP); Takeshi Akai, Kanagawa (JP); Yu Yamaya, Kanagawa (JP); Youhei Niitsuma, Kanagawa (JP)

(72) Inventors: Manabu Yamanaka, Kanagawa (JP); Daisuke Takagi, Kanagawa (JP); Shinnosuke Koshizuka, Kanagawa (JP); Hiroshi Fujie, Kanagawa (JP); Takeshi Akai, Kanagawa (JP); Yu Yamaya, Kanagawa (JP); Youhei Niitsuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/680,741

(22) Filed: Nov. 12, 2019

(65) Prior Publication Data

US 2020/0207112 A1 Jul. 2, 2020

(30) Foreign Application Priority Data

Dec. 28, 2018 (JP) ..... JP2018-246399

(51) Int. Cl.

| | |
|---|---|
| ***B41J 2/175*** | (2006.01) |
| ***B41J 2/185*** | (2006.01) |
| ***B41J 2/14*** | (2006.01) |

(52) U.S. Cl.
CPC ..... *B41J 2/185* (2013.01); *B41J 2/1433* (2013.01); *B41J 2/17566* (2013.01); *B41J 2/17596* (2013.01)

(58) Field of Classification Search
CPC ..... B41J 2/185; B41J 2/1433; B41J 2/17566; B41J 2/17596
See application file for complete search history.

(56) References Cited

U.S. PATENT DOCUMENTS

2012/0286064 A1* 11/2012 Chang ..... B05B 7/144 239/142
2016/0175834 A1 6/2016 Seo et al.
(Continued)

FOREIGN PATENT DOCUMENTS

JP 4108725 B1 * 6/2008 ..... B41J 2/175
JP 2008-213281 * 9/2008 ..... B41J 2/175
(Continued)

OTHER PUBLICATIONS

Machine translation of JP 4108725B1, published on Jun. 2008. (Year: 2008).*
(Continued)

*Primary Examiner* — Huan H Tran
(74) *Attorney, Agent, or Firm* — Oblon, McClelland, Maier & Neustadt, L.L.P.

(57) ABSTRACT

Liquid discharge head comprising: liquid discharge unit, which includes discharge port, liquid retaining section configured to retain liquid to be discharged from the discharge port, and displacement section configured to discharge the liquid retained within the liquid retaining section from the discharge port; a pair of liquid storage sections, which are configured to store the liquid and are each connected to the liquid retaining section in the liquid discharge unit so that the liquid can flow; a pair of liquid feeding sections that are connected to the pair of liquid storage sections and are
(Continued)

configured to feed the liquid between the liquid storage section and the liquid retaining section; and a pair of open and close sections that are each disposed at flow path between the liquid feeding section and the liquid storage section and are configured to open and close the flow path.

18 Claims, 16 Drawing Sheets

(56) References Cited

U.S. PATENT DOCUMENTS

| | | | | |
|---|---|---|---|---|
| 2016/0176191 | A1 | 6/2016 | Kuramochi et al. | |
| 2017/0120604 | A1 | 5/2017 | Seo et al. | |
| 2018/0169650 | A1 | 6/2018 | Somada et al. | |
| 2018/0340880 | A1 | 11/2018 | Matsumoto et al. | |
| 2019/0232661 | A1 * | 8/2019 | Akai | B01F 11/0074 |

FOREIGN PATENT DOCUMENTS

| | | | | |
|---|---|---|---|---|
| JP | 2012-152939 | | 8/2012 | |
| JP | 2014-094485 | | 5/2014 | |
| JP | 2016-116489 | | 6/2016 | |
| WO | WO 2008/108245 | * | 9/2008 | B41J 2/175 |

OTHER PUBLICATIONS

Machine translation of JP 2008-213281, published on Sep. 2008 (Year: 2008).*
U.S. Appl. No. 16/238,570, filed Jan. 3, 2019.
U.S. Appl. No. 16/294,969, filed Mar. 7, 2019.

* cited by examiner

LIQUID DISCHARGE HEAD, LIQUID DISCHARGE DEVICE, DISPENSING DEVICE, AND LIQUID DISCHARGE METHOD

CROSS-REFERENCE TO RELATED APPLICATIONS

The present application claims priority under 35 U.S.C. § 119 to Japanese Patent Application No. 2018-246399 filed Dec. 28, 2018. The contents of which are incorporated herein by reference in their entirety.

BACKGROUND OF THE INVENTION

Field of the Invention

The present disclosure relates to a liquid discharge head, a liquid discharge device, a dispensing device, and a liquid discharge method.

Description of the Related Art

In recent years, due to development of technique of stem cells, technological development for forming an organizational body by discharging a cell suspension has been performed. In this technical field, a liquid discharge device employing an inkjet system that enables discharge so as not to cause damage to cells upon ejecting the cell suspension has been developed.

For example, a droplet discharge device configured to discharge droplets from a discharge port by deforming a film member having a discharge port at a central portion thereof by piezoelectric elements disposed in the form of a ring at edge portions of the bottom portion of the film member and using liquid pressure of liquid housed on the upper surface of the film member has been proposed (for example, see Japanese Unexamined Patent Application Publication No. 2016-116489).

SUMMARY OF THE INVENTION

According to one aspect of the present disclosure, a liquid discharge head of the present disclosure includes: a liquid discharge unit, which includes a discharge port, a liquid retaining section configured to retain liquid to be discharged from the discharge port, and a displacement section configured to discharge the liquid retained within the liquid retaining section from the discharge port; a pair of liquid storage sections, which are configured to store the liquid and are each connected to the liquid retaining section in the liquid discharge unit so that the liquid can flow; a pair of liquid feeding sections that are connected to the pair of liquid storage sections and are configured to feed the liquid between the liquid storage section and the liquid retaining section; and a pair of open and close sections that are each disposed at a flow path between the liquid feeding section and the liquid storage section and are configured to open and close the flow path.

DESCRIPTION OF THE EMBODIMENTS

Figure 1:
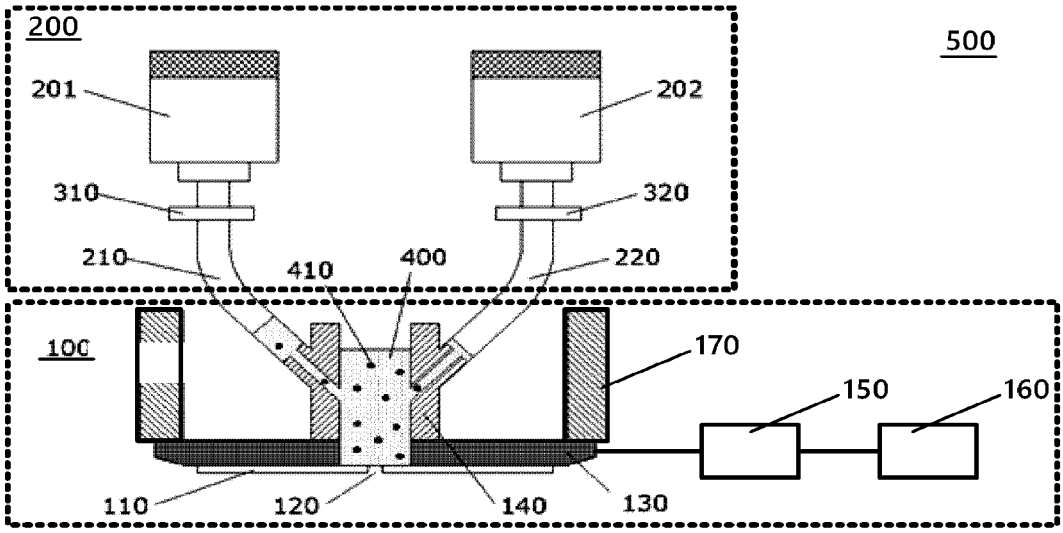
FIG. 1 is a schematic view of one example of a liquid discharge device.

A liquid discharge head of the present disclosure includes a liquid discharge unit, which includes a discharge port, a liquid retaining section configured to retain liquid to be discharged from the discharge port, and a displacement section configured to discharge the liquid retained within the liquid retaining section from the discharge port. The liquid discharge head includes: a pair of liquid storage sections, which are configured to store the liquid and are each connected to the liquid retaining section in the liquid discharge unit so that the liquid can flow; a pair of liquid feeding sections that are connected to the pair of liquid storage sections and are configured to feed the liquid between the liquid storage section and the liquid retaining section; and a pair of open and close sections that are each disposed at a flow path between the liquid feeding section and the liquid storage section and are configured to open and close the flow path.

An object of the present disclosure is to provide a liquid discharge head that enables stable discharge.

According to the present disclosure, it is possible to provide a liquid discharge head that enables stable discharge.

The present disclosure is based on the following finding. Specifically, in the conventional liquid discharge device as described in Japanese Unexamined Patent Application Publication No. 2016-116489, as a cell suspension is discharged, the liquid volume is decreased. Therefore, liquid pressure applied to a discharge port is decreased, and thus a discharge volume is decreased, which is problematic.

Specifically, in the conventional liquid discharge devices, in order to remove bubbles generated inside a liquid housing container, an upper portion of the liquid housing container is open to the air, and liquid pressure (static pressure) applied to a discharge port of a film member depends on height from the film member to a liquid surface of the cell suspension: i.e., hydraulic head. Moreover, driving force for discharging droplets is determined by combination of the dynamic pressure generated by contraction stress (vibration) of a piezoelectric element and the static pressure through hydraulic head. Therefore, the conventional liquid discharge devices may cause "non-discharge" because continuous discharge of the droplets causes a decrease in the liquid volume of the cell suspension within the liquid housing container and a decrease in the hydraulic head, and thus a decrease in the driving force for discharging the droplets may result in failure to discharge the droplets.

In addition, the present disclosure is based on the following finding. Specifically, when a cell suspension is left to stand, precipitated cells easily cause clogging in a discharge port in the conventional liquid discharge device as described in Japanese Unexamined Patent Application Publication No. 2016-116489. As a result, the "non-discharge" may be caused.

Note that, the present disclosure is not limited to the case of the cell suspension, and may be used in order to stir the ink within the liquid retaining section, so that pigments or metal pieces are not precipitated in the case of white ink including heavy pigment contained in the ink and the case of, for example, ink including fine metal pieces for the purpose of imparting metallic appearance to printed matters.

The liquid discharge head of the present disclosure includes a liquid discharge unit, which includes a discharge port, a liquid retaining section (liquid housing container) configured to retain liquid to be discharged from the discharge port, and a displacement section configured to discharge the liquid retained within the liquid retaining section from the discharge port. In addition, the liquid discharge head includes a pair of liquid storage sections, which are configured to store the liquid and are each connected to the liquid retaining section in the liquid discharge unit so that the liquid can flow; and a pair of liquid feeding sections that are connected to the pair of liquid storage sections and are configured to feed the liquid between the liquid storage section and the liquid retaining section. Moreover, the liquid discharge head includes a pair of open and close sections that are each disposed at a flow path between the liquid feeding section and the liquid storage section and are configured to open and close the flow path. As a result, the feeding of the liquid can be securely performed, and the liquid surface height within the liquid retaining section can be easily kept constant, which results in stable discharge.

When the liquid within the liquid retaining section includes particles, the liquid discharge head of the present disclosure can stabilize the discharge because clogging of particles such as cells in the discharge port is hardly caused by feeding the liquid within the liquid retaining section to be stirred.

Moreover, in the liquid discharge head of the present disclosure, the liquid discharge unit may further include a liquid surface detection section configured to detect liquid surface height within the liquid retaining section, so that opening and closing the pair of open and close sections is controlled based on detection results of the liquid surface height provided by the liquid surface detection section. This makes it possible for the liquid discharge head of the present disclosure to keep the liquid surface height constant within the liquid retaining section, and to more securely stabilize the discharge.

In the liquid discharge head of the present disclosure, a pair of liquid feeding sections may feed the liquid stored in one liquid storage section to the liquid retaining section while feeding the liquid from the liquid retaining section to the other liquid storage section. This makes it possible for the liquid discharge head of the present disclosure to keep the liquid surface height constant within the liquid retaining section, and to stabilize the discharge.

Moreover, the liquid discharge head of the present disclosure may further include a controller configured to control at least one selected from the group consisting of the pair of liquid feeding sections and the pair of open and close sections so that liquid surface height within the liquid retaining section is constant. As a result, the liquid discharge head of the present disclosure can stabilize the discharge.

The liquid discharge head of the present disclosure may include: a plurality of the liquid discharge units; the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections. In this case, when the liquid discharge head further includes the pairs of open and close sections that are same in number as the pairs of liquid storage sections, control of the pairs of open and close sections that are same in number as the pairs of liquid feeding sections and the pairs of liquid storage sections can selectively feed the liquid within at least one liquid retaining section in the plurality of the liquid discharge units.

When the liquid discharge head of the present disclosure includes a plurality of the liquid discharge units, the control may be performed so that volume of the liquid to be fed from the at least one liquid retaining section is different from volume of the liquid to be fed from other liquid retaining sections. As a result, the liquid discharge head of the present disclosure can appropriately stir the liquid depending on the kind of the liquids even when the liquids within all the liquid retaining sections are different in the kinds and stirring forces required are different. Therefore, the discharge can be stabilized.

The liquid discharge head of the present disclosure may further include a volume detection section configured to detect volume of the liquid in the liquid storage section. This makes it possible for the liquid discharge head of the present disclosure to more securely stabilize the discharge by controlling at least one selected from the group consisting of the pair of liquid feeding sections and the pair of open and close sections based on detection results of the volume detection section.

In the liquid discharge head of the present disclosure, the liquid may be stored in advance in at least one of the pair of liquid storage sections. As a result, in the case where liquid volume of the liquid within the liquid retaining section is smaller than a predetermined value, when the liquid is fed to the liquid retaining section from at least one of the pair of liquid storage sections, the liquid discharge head of the present disclosure can promptly supply the liquid to the liquid retaining section.

In the liquid discharge head of the present disclosure, when the liquid volume of the liquid within the liquid retaining section is smaller than a predetermined value, control for feeding the liquid from at least one of the pair of liquid storage sections to the liquid retaining section may be performed. This makes it possible for the liquid discharge head of the present disclosure to promptly supply the liquid to the liquid retaining section.

In the liquid discharge head of the present disclosure, control may be performed so that the liquid is not fed to a side of the liquid feeding section beyond the open and close section. This makes it possible to prevent liquids different in the kinds from being mixed even when the liquid discharge head of the present disclosure includes a plurality of the liquid discharge units and the liquids retained within the liquid retaining sections are different in the kinds.

The liquid discharge device of the present disclosure includes the liquid discharge head of the present disclosure. As a result, the liquid discharge device of the present disclosure can stabilize the discharge.

A dispensing device of the present disclosure includes the liquid discharge device of the present disclosure and a target to be impacted configured to house liquid discharged by the liquid discharge device. This makes it possible for the dispensing device of the present disclosure to stabilize the discharge. Therefore, it is possible to decrease variation of the liquid housed in the target to be impacted.

A liquid discharge method of the present disclosure is a liquid discharge method capable of discharging liquid, and includes a liquid discharging step, a liquid storage step, a liquid feeding step, an opening and closing step, and a control step.

The liquid discharge method of the present disclosure can be suitably performed by the liquid discharge head of the present disclosure. The liquid discharging step can be suitably performed by the liquid discharge unit. The liquid storage step can be suitably performed by the liquid storage section. The liquid feeding step can be suitably performed by the liquid feeding section. The opening and closing step can be suitably performed by the open and close section. The control step can be suitably performed by the controller. Other steps can be performed by other units.

That is, the liquid discharge device of the present disclosure is similar to performing the liquid discharge method of the present disclosure. Therefore, through explanation in connection with the liquid discharge device of the present disclosure, details of the liquid discharge method of the present disclosure will be clarified.

Hereinafter, a plurality of embodiments in the present disclosure will be described. However, the present disclosure is not limited to these embodiments.

In each drawing, the same reference numeral is given to the same component section, and redundant description may be omitted in some cases. For example, the number, position, and shape of the following component members are not limited to the embodiments of the present disclosure. The preferable number, position, and shape thereof can be set in order to perform the present disclosure.

(Liquid Discharge Device)

FIG. 1 is a schematic view of one example of a liquid discharge device.

As presented in FIG. 1, a liquid discharge device 500 includes a liquid discharge head 100 and a liquid retaining and stirring unit 200.

<Liquid Discharge Head>

The liquid discharge head 100 includes a liquid discharge unit including: a nozzle plate 110 in which a discharge port 120 is formed; a vibration member 130 as a displacement section; a liquid retaining section 140; a drive section 150 configured to drive the vibration member 130; a controller 160; and a housing 170.

The liquid retaining and stirring unit 200 includes: a first liquid feeding unit 201; a second liquid feeding unit 202; a flow path 210 that connects the first liquid feeding unit 201 and the liquid retaining section 140; and a flow path 220 that connects the second liquid feeding unit 202 and the liquid retaining section 140. The flow path 210 is provided with a shut-off valve 310 and the flow path 220 is provided with a shut-off valve 320.

The first liquid feeding unit 201 and the second liquid feeding unit 202 function as a pair of liquid feeding sections. The flow path 210 and the flow path 220 function as a pair of liquid storage sections. The shut-off valve 310 and the shut-off valve 320 function as a pair of open and close sections.

FIG. 1 schematically presents a state that a solution 400 including particles 410 is retained within the liquid retaining section 140.

In the present embodiment, for the sake of convenience of explanation, when the vibration member 130 is considered as a standard, a side of the liquid retaining section 140 is considered as an upper side, and a side of the nozzle plate 110 is considered as a bottom side. In each part, a surface at a side of the liquid retaining section 140 is considered as an upper surface, and a surface at a side of the nozzle plate 110 is considered as a bottom surface.

A plane view means that an object is seen from an upper surface or a bottom surface of a member. A plane shape means a shape obtained when an object is seen from an upper surface or a bottom surface of a member.

«Liquid Retaining Section»

The liquid retaining section 140 retains a solution 400 including the particles 410 (the particles 410 are dispersed). In other words, the liquid retaining section 140 retains a liquid to be discharged from the discharge port 120.

An upper portion of the liquid retaining section 140 is open to the air and bubbles included in the solution 400 are discharged into the air.

Examples of the material of the liquid retaining section 140 include metals, resins, silicone, and ceramics.

«Nozzle Plate»

The nozzle plate 110 is fixed at a bottom end of the liquid retaining section 140 via the vibration member 130.

The discharge port (nozzle) 120 that is a through hole is formed nearly at a center of the nozzle plate 110. The solution 400 retained within the liquid retaining section 140 is discharged as droplets from the nozzle 120 by vibrating the nozzle plate 110.

A plane shape of the nozzle plate 110 may be, for example, circular, but may be, for example, elliptic or rectangular.

A material of the nozzle plate 110 is stainless steel in the present embodiment.

Note that, in the present embodiment, the material of the nozzle plate 110 is stainless steel. However, the material thereof is not limited thereto, and is preferably a material having a certain degree of hardness. When the nozzle plate 110 has a certain degree of hardness, the nozzle plate 110 does not easily vibrate, and it is easy to immediately suppress vibration when the nozzle does not discharge droplets, which is advantageous.

Examples of the material having a certain degree of hardness include metal materials, ceramic materials, and polymer materials. Among them, when the liquid is a cell suspension, the material is preferably a material having low adhesiveness to cells.

The discharge port (nozzle) 120 is preferably formed as a through hole having a shape of a substantially perfect circle nearly at a center of the nozzle plate 110. In this case, a diameter of the nozzle 120 is not particularly limited and may be appropriately selected depending on the intended purpose. The diameter thereof is preferably twice or more the size of the particles 410 in order to prevent clogging of the particles 410 in the nozzle 120.

«Vibration Member (Displacement Section)»

The vibration member 130 as a displacement section is formed at a side of the upper surface of the nozzle plate 110. That is, the vibration member 130 is disposed at a side of the liquid retaining section 140 configured to retain the solution 400 to be discharged from the discharge port 120.

A shape of the vibration member 130 can be designed depending on a shape of the nozzle plate 110. For example, when a plane shape of the nozzle plate 110 is circular, the vibration member 130 having an annular (ring) plane shape is preferably formed around the nozzle 120.

The vibration member 130 is, for example, a piezoelectric element including electrodes configured to apply voltage to the upper surface and the bottom surface of a piezoelectric material. By applying voltage to the upper and bottom electrodes of the vibration member 130, contraction stress is applied in all directions, which makes it possible to vibrate the nozzle plate 110.

Note that, the vibration member that vibrates the nozzle plate 110 is not limited to the piezoelectric element. For example, by pasting, on the nozzle plate 110, a material having a different coefficient of linear expansion from that of the nozzle plate 110 and then heating it, the nozzle plate 110 can be vibrated by using a difference between the coefficients of linear expansion. In this case, the nozzle plate 110 is preferably vibrated by providing the material having a different coefficient of linear expansion with a heater and then heating the heater through electrification.

The drive section 150 drives the vibration member 130. The drive section 150 can vibrate the nozzle plate 110 to give a discharge waveform (discharge signal) that forms droplets to the vibration member 130.

That is, the drive section 150 can discharge the solution 400 retained within the liquid retaining section 140 as droplets from the nozzle 120 by giving the discharge waveform to the vibration member 130 and controlling the state of vibration of the nozzle plate 110.

Examples of the particles 410 in the solution 400 including the particles 410 include metal fine particles, inorganic fine particles, and cells. Among them, cells are preferable.

As a solvent of the solution 400, water is the most general solvent. However, the solvent is not limited thereto, and various organic solvents such as alcohols, mineral oils, and vegetable oils can be used.

A volume of the solution 400 retained within the liquid retaining section 140 is not particularly limited and may be appropriately selected depending on the intended purpose. However, the volume thereof is preferably 1 μL or more but 1 mL or less. Particularly, when an expensive liquid such as the cell suspension is used, the volume thereof is more preferably 1 μL or more but 200 μL or less, in order to form droplets with a small liquid volume.

«Liquid Feeding Unit (Liquid Feeding Section)»

The first liquid feeding unit 201 and the second liquid feeding unit 202 as a pair of liquid feeding sections are connected to the flow path 210 and the flow path 220, respectively, and feed the solution 400 between the flow path 210/flow path 220 and the liquid retaining section 140.

The feeding of the solution 400 with the first liquid feeding unit 201 and the second liquid feeding unit 202 is preferably performed by allowing the solution 400 stored in one flow path to flow into the liquid retaining section 140, while allowing the solution 400 to flow into the other flow path from the liquid retaining section 140 by such a volume that has flown from the one flow path to the liquid retaining section 140. This can make the liquid surface height of the solution 400 stable within the liquid retaining section 140. Therefore, as in the present embodiment, the discharge can be stabilized by making the liquid pressure constant, in the liquid discharge head 100 configured to discharge the solution 400 through liquid pressure (static pressure) applied to the discharge port 120 by the solution 400 housed in the liquid housing unit 140 and through motion (dynamic pressure) that displaces the discharge port 120.

When a liquid volume of the solution 400 retained within the liquid retaining section 140 is smaller than a predetermined volume, the liquid feeding unit preferably allows the solution 400 to flow into the liquid retaining section 140 from at least one of the flow paths. This makes it possible for the liquid discharge head 100 to supply the solution 400 to the liquid retaining section 140. Therefore, liquid pressure can be constant to thereby stabilize the discharge.

Examples of the first liquid feeding unit 201 and the second liquid feeding unit 202 include pumps capable of sucking, retaining, and discharging liquid at a predetermined liquid volume such as syringe-type electric pumps and plunger-type electric pumps.

As the flow path 210 that connects the first liquid feeding unit 201 with the liquid retaining section 140 and the flow path 220 that connects the second liquid feeding unit 202 with the liquid retaining section 140, a silicone rubber tube is desirable. The inner diameter and length of the silicone rubber tube are not particularly limited and may be appropriately selected depending on the intended purpose.

«Two Flow Paths (Pair of Liquid Storage Sections)»

The flow path 210 and the flow path 220 as a pair of liquid storage sections are each connected to the liquid retaining section 140 so that the solution 400 can flow, and can temporarily store the solution 400.

Moreover, the flow path 210 and the flow path 220 are exchangeable and the volume thereof can be changed by adjusting the inner diameter or length. These two flow paths are slantingly disposed with respect to the nozzle 120 (nozzle plate 110). That is, the flow paths are slantingly disposed with respect to a central axis passing through the nozzle 120.

The flow path 210 and the flow path 220 are preferably disposed so that an extended line of a central axis of the connection portion corresponds to a corner formed by the nozzle plate 110 and the vibration member 130 or corresponds to a portion slightly closer to a side of the nozzle 120 from the corner.

«Shut-Off Valve (A Pair of Open and Close Sections)»

The shut-off valve 310 and the shut-off valve 320 as a pair of open and close sections are disposed at a flow path between the first liquid feeding unit 201 and the flow path 210 and at a flow path between the second liquid feeding unit 202 and the flow path 220, respectively. Each of the shut-off valve 310 and the shut-off valve 320 opens and shuts the flow path.

«Controller»

The controller 160 controls the first liquid feeding unit 201 and the second liquid feeding unit 202, and the shut-off valve 310 and shut-off valve 320, so that a liquid surface height of the solution 400 retained within the liquid retaining section 140 is constant.

The controller 160 includes, for example, CPU (Central Processing Unit), ROM (Read Only Memory), RAM (Random Access Memory), and main memory, and executes various processes based on the control program for controlling the operation of the whole liquid discharge device.

In the present embodiment, the housing 170 has a cylinder shape and houses the liquid retaining section 140. At a bottom end portion of the bottom surface of the housing 170, an edge of the vibration member 130 is fixed.

Figure 2:
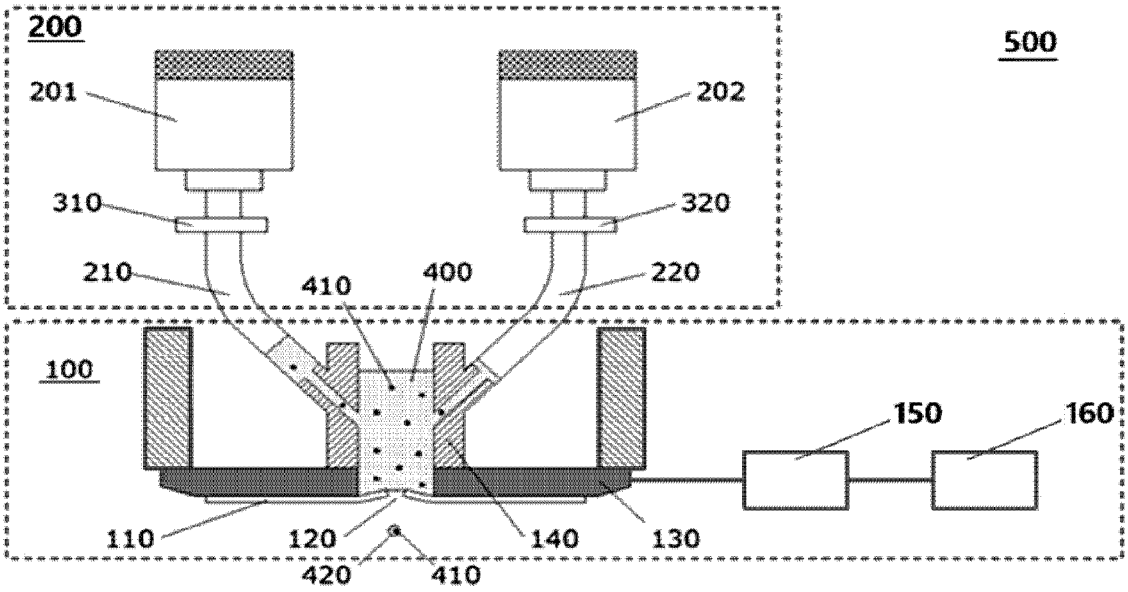
FIG. 2 is a schematic view presenting one example of processes for forming droplets with a liquid discharge device.

FIG. 2 is a schematic view presenting one example of processes for forming droplets with a liquid discharge device. FIG. 2 schematically presents a state that a discharge waveform is input from a drive section 150 to a vibration member 130 and a droplet 420 is formed through vibration of a nozzle plate 120.

Based on the discharge waveform, vibration is generated via the vibration member 130 at a portion of a nozzle plate 110 that is not in contact with the vibration member 130, and the portion of the nozzle 120 has the largest amplitude. A solution 400 within the liquid retaining section 140 is discharged as the droplet 420 through vibration of the nozzle 120.

Figure 3:
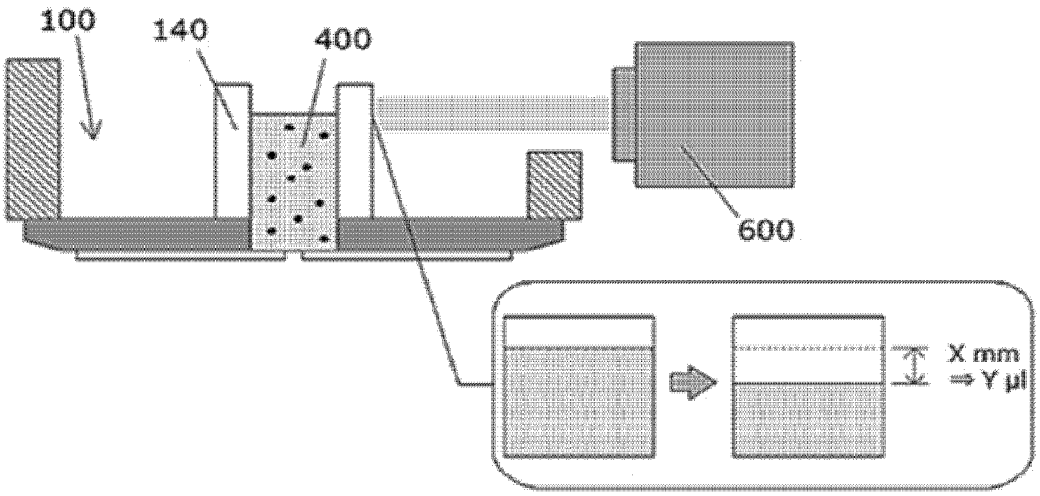
FIG. 3 is a schematic view presenting one example of a state that a liquid surface detection unit configured to detect a liquid surface height of a solution within a liquid retaining section of a liquid discharge head is disposed.

FIG. 3 is a schematic view presenting one example of a state that a liquid surface detection unit configured to detect a liquid surface height of a solution within a liquid retaining section of a liquid discharge head is disposed.

A liquid surface detection unit 600 always detects the liquid surface height of a solution 400 within a liquid retaining section 140 and executes feedback control to a first liquid feeding unit 201 and a second liquid feeding unit 202 based on detection results.

The liquid surface detection unit 600 is preferably an image sensor, but may be other units such as water detection sensors using a photoelectric sensor or those using a light emitting element or a position sensor. At least an area of the liquid retaining section 140 of a liquid discharge head 100 where a liquid surface is detected is preferably transparent.

Figure 4A:
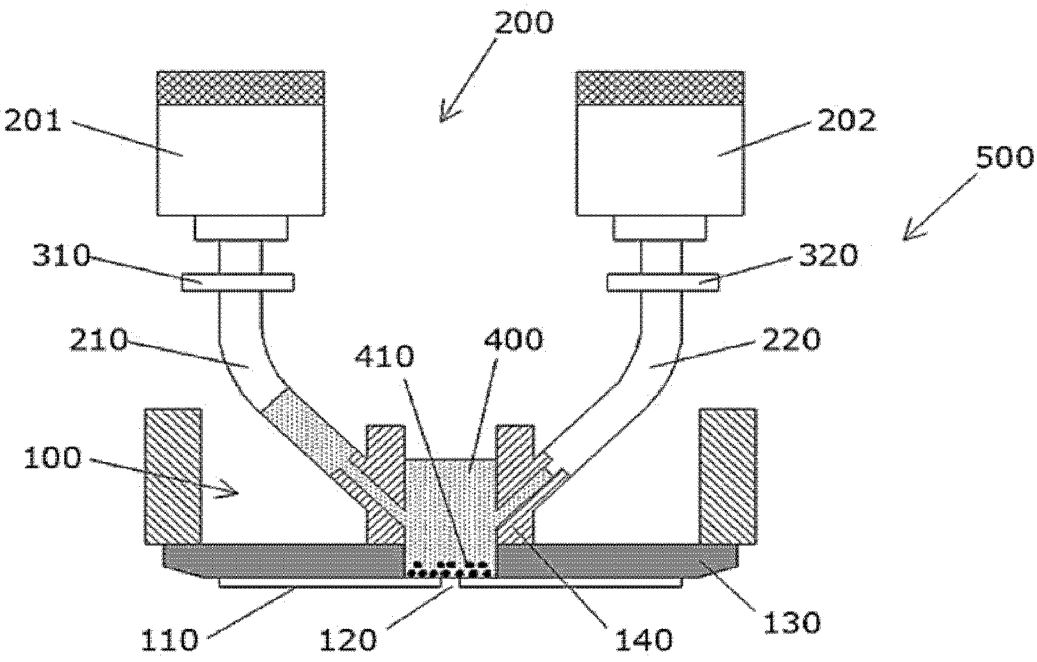
FIG. 4A is an explanatory view presenting one example of stirring operation of a solution within a liquid retaining section using a first liquid feeding unit and a second liquid feeding unit.
Figure 4B:
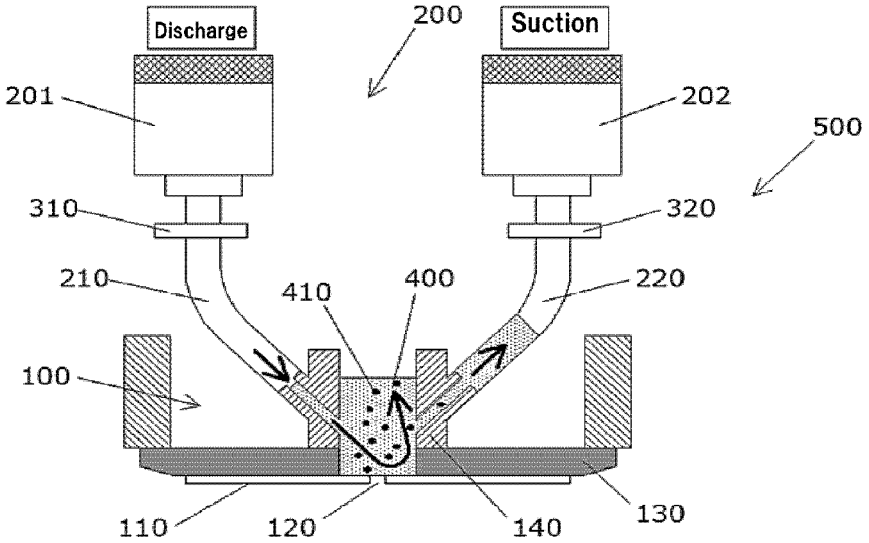
FIG. 4B is an explanatory view presenting one example of stirring operation of a solution within a liquid retaining section using a first liquid feeding unit and a second liquid feeding unit.
Figure 4C:
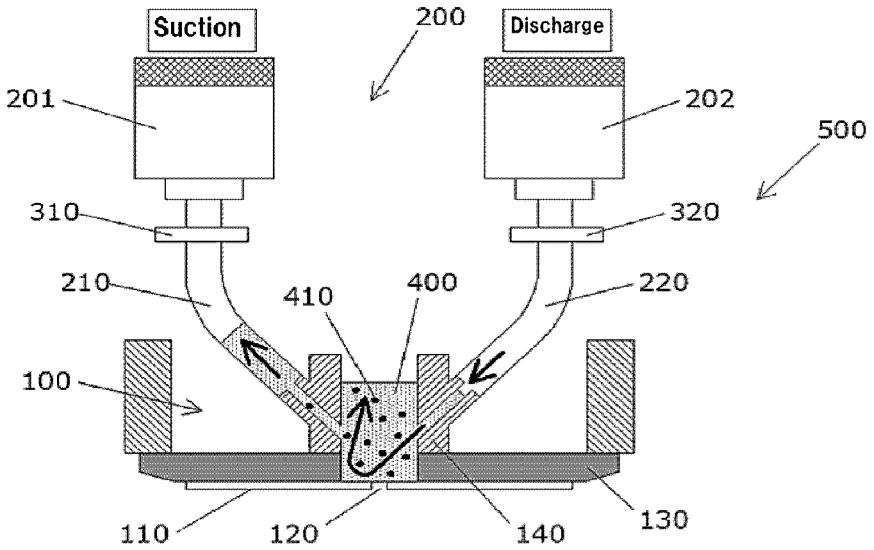
FIG. 4C is an explanatory view presenting one example of stirring operation of a solution within a liquid retaining section using a first liquid feeding unit and a second liquid feeding unit.

FIGS. 4A to 4C are each an explanatory view presenting one example of stirring operation of a solution within a liquid retaining section using a first liquid feeding unit and a second liquid feeding unit.

More specifically, FIG. 4A is an explanatory view presenting one example of a state that a solution 400 including particles 410 is charged into a liquid retaining section 140 and is left to stand. FIG. 4A presents a state that the particles 410 are precipitated at the bottom portion of the liquid retaining section 140 due to free settling of the particles 410 and are deposited. When droplets are discharged in this state, the particles 410 are aggregated near a nozzle 120, and thus the particles 410 aggregated in the nozzle 120 result in clogging. As a result, such a failure that droplets are not formed (i.e., droplets are not discharged) may be possibly caused.

Even when droplets can be formed, initial droplets include a large amount of the particles 410 to thereby be discharged, and thus an amount of the particles 410 contained in droplets is gradually decreased. Therefore, when the particles 410 above the nozzle 130 are discharged, a state that only the supernatant is discharged is found, and a large variation in the amount of the particles 410 in a droplet 420 over time is caused, which is problematic.

FIGS. 4B and 4C are each an explanatory view presenting one example of a redispersion process of the particles 410 by stirring the solution 400 retained within the liquid retaining section 140 using a first liquid feeding unit 201 and a second liquid feeding unit 202.

As presented in FIG. 4A, a predetermined volume of the solution 400 within the liquid retaining section 140 is sucked and maintained by allowing any one of the first liquid feeding unit 201 and the second liquid feeding unit 202 to perform suction operation in advance and making the pressure inside the flow path negative. In the present embodiment, an example where the first liquid feeding unit 201 performs suction and retention is presented.

FIG. 4B is a view presenting one example of a state the first liquid feeding unit 201 performs the discharge operation and the second liquid feeding unit 202 performs the suction operation.

When the first liquid feeding unit 201 performs the discharge operation to thereby make the pressure inside a flow path 210 positive, the sucked and retained solution 400 is discharged into the liquid retaining section 140. The discharged solution 400 forms a flow substantially parallel to the central axis of the portion linking the flow path 210 with the liquid retaining section 140. Then, upwelling stream along the wall surface of the liquid retaining section 140 disperses the particles 410 deposited at a corner formed by a nozzle plate 110 and the vibration member 130 in an upward direction of the liquid retaining section 140.

Moreover, when the second liquid feeding unit 202 performs the suction operation to thereby make the pressure inside a flow path 220 negative, a predetermined volume of the solution 400 within the liquid retaining section 140 is sucked and retained.

Subsequently, as presented in FIG. 4C, when the second liquid feeding unit 202 performs the discharge operation to thereby make the pressure inside the flow path 210 positive, the sucked and retained solution 400 is discharged into the liquid retaining section 140. The discharged solution 400 generates an upward flow again within the liquid retaining section 140 and disperses the particles 410 in an upward direction of the liquid retaining section 140.

By repeating the above operations, it is possible to redisperse the particles 410 precipitated at the bottom of the liquid retaining section 140 with a small liquid volume. By forming droplets with the particles 410 redispersed, it is possible to prevent failure to discharge the particles 410 due to precipitation and a change of a concentration of the particles 410 contained in the discharged droplet 420 over time.

When arrangement of the flow path 210 and the flow path 220 is shifted to one side with respect to the central axis passing through the nozzle 120, distribution of the particles 410 within the liquid retaining section 140 varies. Therefore, it is preferable that the flow path 210 and the flow path 220 be symmetrically disposed.

The first liquid feeding unit 201 and the second liquid feeding unit 202 preferably have the same values in a suction rate, a discharge rate, a volume of the sucked liquid, and a volume of the discharged liquid, in order to homogeneously disperse the particles 410 within the liquid retaining section 140.

Figure 5A:
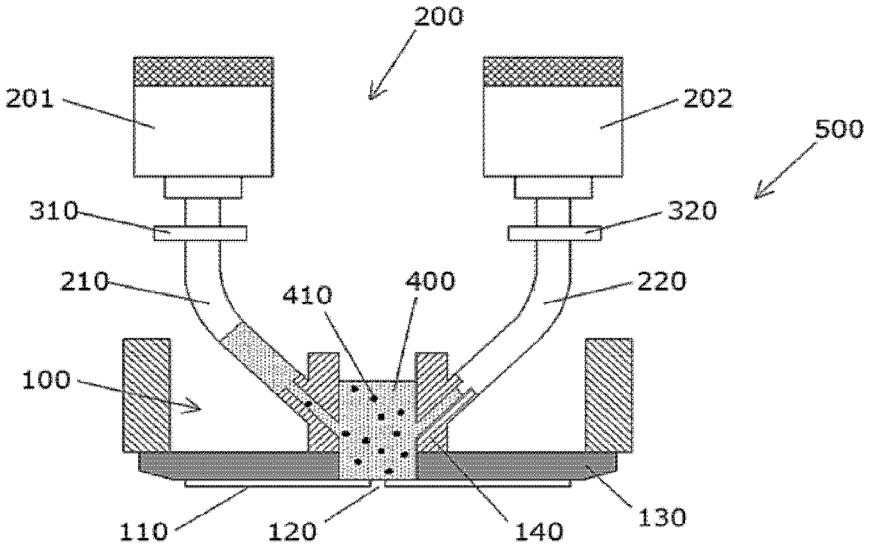
FIG. 5A is an explanatory view presenting one example of a state that a first liquid feeding unit and a second liquid feeding unit are alternately operated.
Figure 5B:
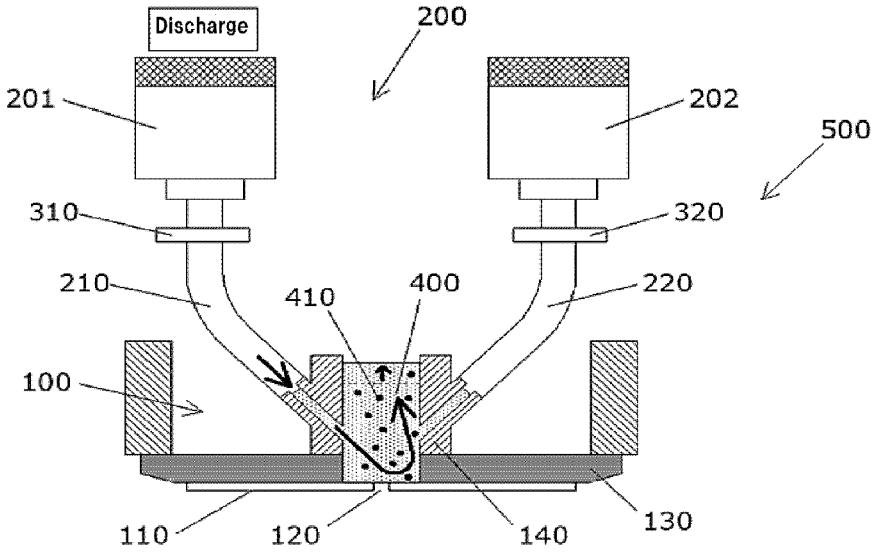
FIG. 5B is an explanatory view presenting one example of a state that a first liquid feeding unit and a second liquid feeding unit are alternately operated.
Figure 5C:
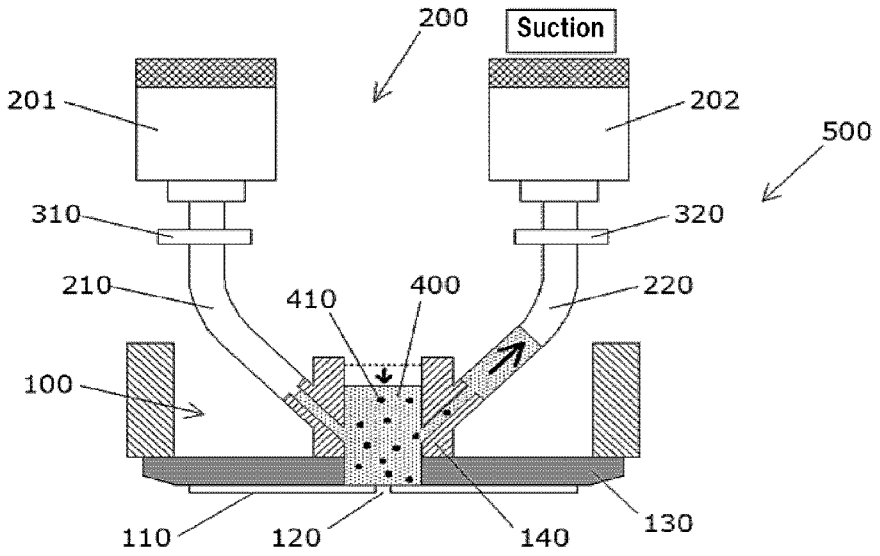
FIG. 5C is an explanatory view presenting one example of a state that a first liquid feeding unit and a second liquid feeding unit are alternately operated.

FIGS. 5A to 5C are each an explanatory view presenting one example of a state that a first liquid feeding unit and a second liquid feeding unit are alternately operated.

FIG. 5A presents one example of a state that a solution 400 is retained in advance inside a flow path 210 connecting a first liquid feeding unit 201 with a liquid retaining section 140 with both the first liquid feeding unit 201 and a second liquid feeding unit 202 being stopped.

FIG. 5B presents one example of a state that particles 410 contained in the solution 400 are redispersed by allowing the first liquid feeding unit 201 to perform the discharge operation and generating a stirring flow into the solution 400 within the liquid retaining section 140. At this time, because the second liquid feeding unit 202 is stopped, the solution 400 that has been sucked inside the flow path 210 in advance is allowed to flow into the liquid retaining section 140. Therefore, a liquid volume of the solution 400 within the liquid retaining section 140 is increased, and the liquid surface rises.

FIG. 5C presents one example of a state that the second liquid feeding unit 202 performs the suction operation after the first liquid feeding unit 201 completes the operation. By sucking a liquid volume that has flown into the liquid retaining section 140 with the second liquid feeding unit 202 and retaining it within a flow path 220, the liquid volume of the solution 400 within the liquid retaining section 140 is decreased to cause the liquid surface to fall. As a result, it is possible to return to the state before the operation.

Figure 6:
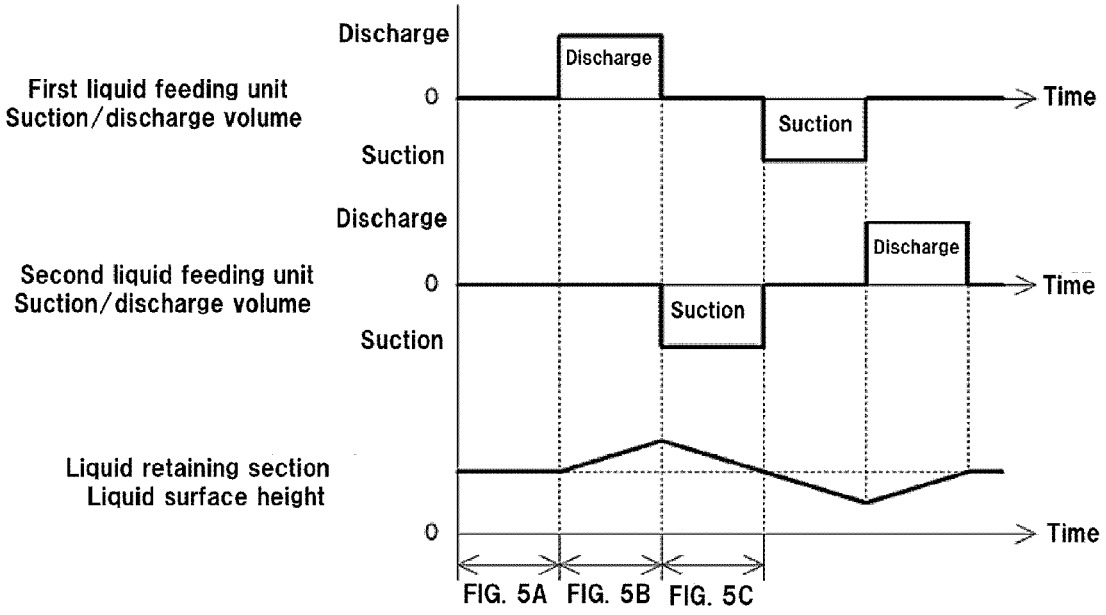
FIG. 6 is an explanatory diagram presenting one example of a change of a liquid surface height within a liquid retaining section when a first liquid feeding unit and a second liquid feeding unit are alternately operated.

FIG. 6 is an explanatory diagram presenting one example of a change of a liquid surface height within a liquid retaining section when a first liquid feeding unit and a second liquid feeding unit are alternately operated. Contrary to the examples presented in FIG. 5B and FIG. 5C, when one liquid feeding unit performs the suction operation before the other liquid feeding unit performs the discharge operation, a liquid surface height within the liquid retaining section 140 falls once and then rises. As a result, it returns to the state before the operation.

When the precipitated particles 410 are redispersed with the discharge of the droplets from the nozzle 120 being stopped, redispersion can be performed in the present operation.

Meanwhile, it can be expected that stirring the solution 400 generally achieves effects such as redispersion of the particles 410 precipitated as described above as well as prevention of precipitation of the dispersed particles 410.

When the stirring operation within the liquid retaining section 140 is performed during the droplet discharge operation presented in FIG. 2, it is possible to discharge droplets while precipitation of the particles 410 is prevented and the homogeneous dispersion state is always maintained. Therefore, a concentration of the particles contained in the droplet 420 can be kept constant over time.

Here, as presented in FIGS. 5A to 5C, when the first liquid feeding unit 201 and the second liquid feeding unit 202 are alternately operated, a change of the liquid surface height of the solution 400 within the liquid retaining section 140 as described above results in a change of the hydraulic pressure applied to the nozzle plate 110, and a fall velocity of the droplet 420 to be discharged also changes.

This configuration is favorable when the droplet 420 is continuously continued to be discharged at one portion. However, when the droplet 420 is to be disposed at regular intervals, the discharge operation is generally performed at a constant cycle while a droplet forming unit or a droplet retaining member including the droplet 420 is moved at a constant rate. Therefore, when the fall velocity of the droplet 420 changes, an impact position of the droplet 420 changes, and intervals between the droplets 420 on a droplet retaining member are not uniform.

As presented in FIGS. 4A to 4C, it is possible to stir the solution 400 with the liquid volume within the liquid retaining section 140 being kept constant, by performing the suction operation of the second liquid feeding unit 202 in synchronization with the discharge operation of the first liquid feeding unit 201 or performing the discharge operation of the second liquid feeding unit 202 in synchronization with the suction operation of the second liquid feeding unit 201.

Figure 7:
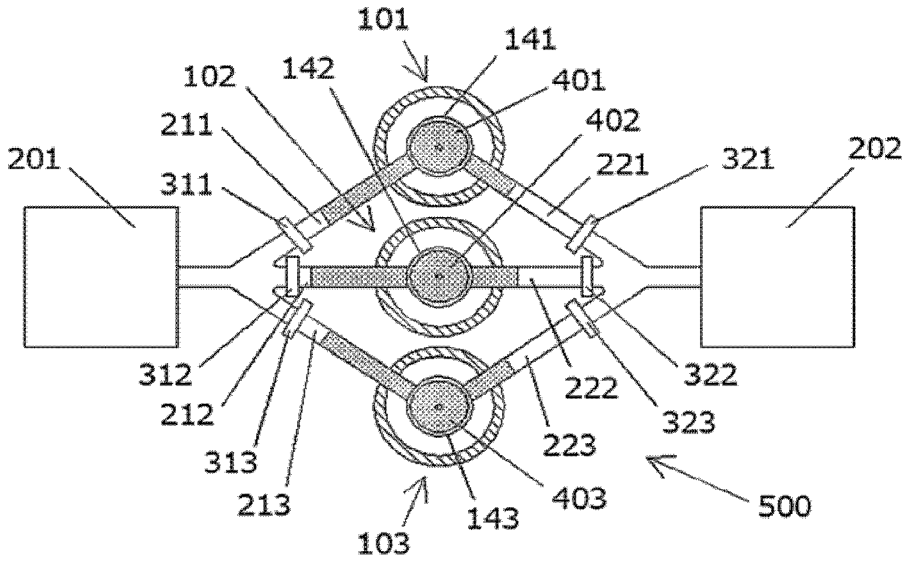
FIG. 7 is a plan view presenting one example of a liquid discharge device of the present disclosure.

FIG. 7 is a plan view presenting one example of a liquid discharge device of the present disclosure.

A liquid discharge device 500 presented in FIG. 7 includes three liquid discharge heads and liquid retaining and stirring units 200. Here, the number of the liquid discharge heads is not limited thereto.

A first liquid discharge head 101 includes a first liquid retaining section 141 configured to retain a solution 401. The first liquid retaining section 141 is connected to a first liquid feeding unit 201 via a flow path 211 and is connected to a second liquid feeding unit 202 via a flow path 221. The flow path 211 is provided with a shut-off valve 311 and the flow path 221 is provided with a shut-off valve 321.

Preferable examples of the shut-off valve as an open and close section include electromagnetic valves capable of remotely opening and shutting the valve. Examples of the material of the shut-off valve include various materials, irrespective of metals and nonmetals, such as stainless steels, aluminum, fluorine-based resins, and fluororubbers.

The shut-off valve can preferably open and close at least one selected from the group consisting of a flow path between one liquid storage section and the liquid retaining section and a flow path between the other liquid storage section and the liquid retaining section. This makes it possible for the liquid discharge head to more securely suck and discharge the solution.

Moreover, a second liquid discharge head 102 includes a second liquid retaining section 142 configured to retain the solution 402. The second liquid retaining section 142 is connected to the first liquid feeding unit 201 via a flow path 212 and is connected to the second liquid feeding unit 202 via a flow path 222. Likewise, a third liquid discharge head 103 includes a third liquid retaining section 143 configured to retain a solution 403. The third liquid retaining section 143 is connected to the first liquid feeding unit 201 via a flow path 213 and is connected to the second liquid feeding unit 202 via a flow path 223.

Figure 8A:
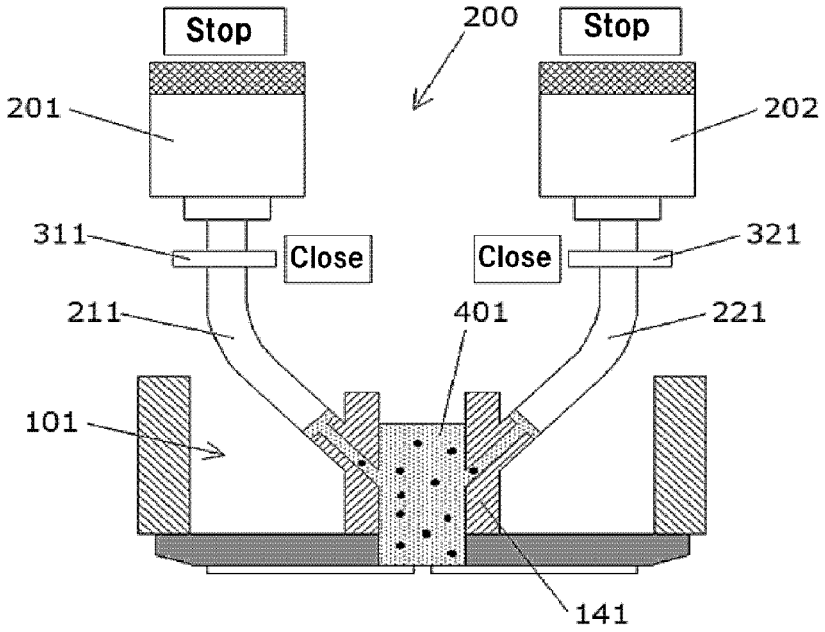
FIG. 8A is a schematic view presenting one example of operation of a first liquid discharge unit in a liquid discharge device of the present disclosure.
Figure 8B:
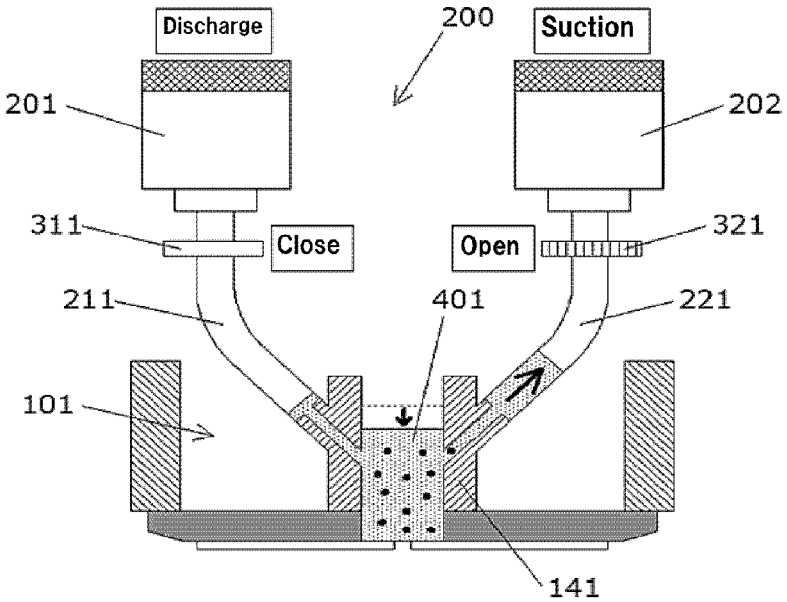
FIG. 8B is a schematic view presenting one example of operation of a first liquid discharge unit in a liquid discharge device of the present disclosure.
Figure 8C:
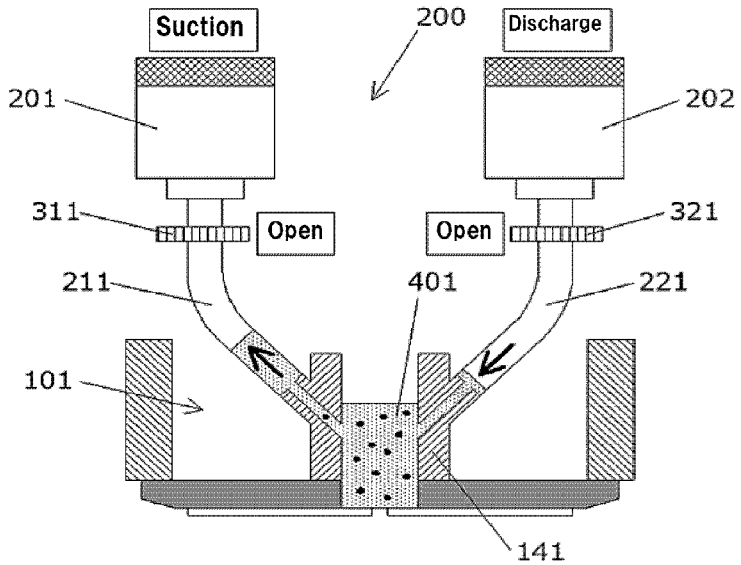
FIG. 8C is a schematic view presenting one example of operation of a first liquid discharge unit in a liquid discharge device of the present disclosure.

FIGS. 8A to 8C are each a schematic view presenting one example of operation of a first liquid discharge unit in a liquid discharge device of the present disclosure.

In FIG. 8A, both a first liquid feeding unit 201 and a second liquid feeding unit 202 are stopped. Both a shut-off valve 311 provided at a flow path 211 connecting the first liquid feeding unit 201 and a first liquid retaining section 141 and a shut-off valve 321 provided at a flow path 221 connecting the second liquid feeding unit 202 and the first liquid retaining section 141 are closed.

In FIG. 8B, when the first liquid feeding unit 201 performs the discharge operation and the second liquid feeding unit 202 performs the suction operation, the shut-off valve 311 is closed and the shut-off valve 321 is opened. The first liquid feeding unit 201 performs the discharge operation but the shut-off valve 311 is closed. Therefore, a solution 400 within the flow path 211 is retained without discharging the solution 400 into the first liquid retaining section 141.

Meanwhile, the second liquid feeding unit 202 performs the suction operation and the shut-off valve 321 is closed. Therefore, the solution 401 within the first liquid retaining section 141 is sucked into the flow path 221 and is retained. At this time, the liquid volume of the solution 401 within the first liquid retaining section 141 is decreased, and thus the liquid surface falls.

Next, in FIG. 8C, when the first liquid feeding unit 201 performs the suction operation and the second liquid feeding unit 202 performs the discharge operation, both the shut-off valve 311 and the shut-off valve 321 are opened. The first liquid feeding unit 201 performs the suction operation and the shut-off valve 311 is opened. Therefore, the solution 401 within the first liquid retaining section 141 is sucked into the flow path 211 and is retained.

Meanwhile, the second liquid feeding unit 202 performs the discharge operation, and the shut-off valve 321 is opened. Therefore, the solution 401 retained in the flow path 221 is discharged into the first liquid retaining section 141. In this case, when a suction volume from the first liquid retaining section 141 with the first liquid feeding unit 201 and a discharge volume to the first liquid retaining section 141 with the second liquid feeding unit 202 are the same, the liquid volume of the solution 401 within the first liquid retaining section 141 does not change, and thus the liquid surface does not change.

Figure 8D:
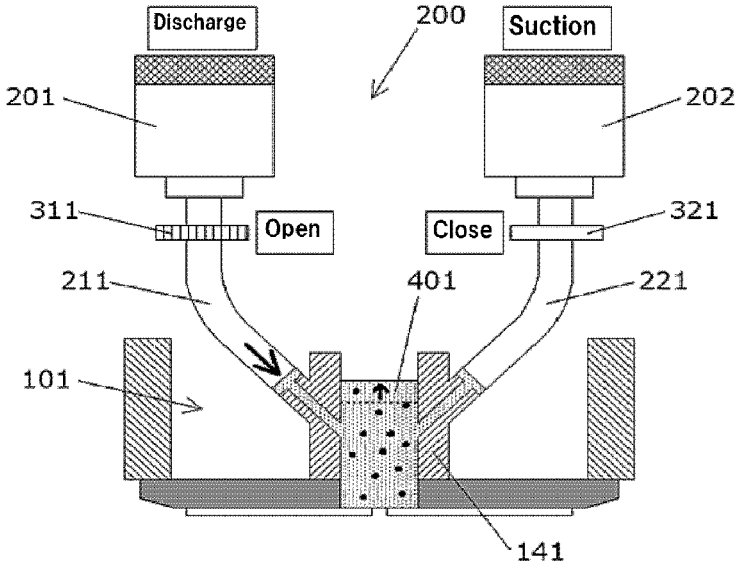
FIG. 8D is a schematic view presenting one example of operation of a first liquid discharge unit in a liquid discharge device of the present disclosure.

Subsequently, FIG. 8D presents a state that when the first liquid feeding unit 201 performs the discharge operation and the second liquid feeding unit 202 performs the suction operation, the shut-off valve 311 is opened and the shut-off valve 321 is closed. The first liquid feeding unit 201 performs the discharge operation and the shut-off valve 311 is opened. Therefore, the solution 401 retained within the flow path 211 is discharged into the first liquid retaining section 141.

Meanwhile, the second liquid feeding unit 202 performs the suction operation, and the shut-off valve 321 is closed. Therefore, the solution 401 within the first liquid retaining section 141 is not sucked into the flow path 221. The solution 401 retained within the flow path 221 is discharged into the first liquid retaining section 141. At this time, the liquid volume of the solution 401 within the first liquid retaining section 141 is increased, and thus the liquid surface rises.

Figure 9:
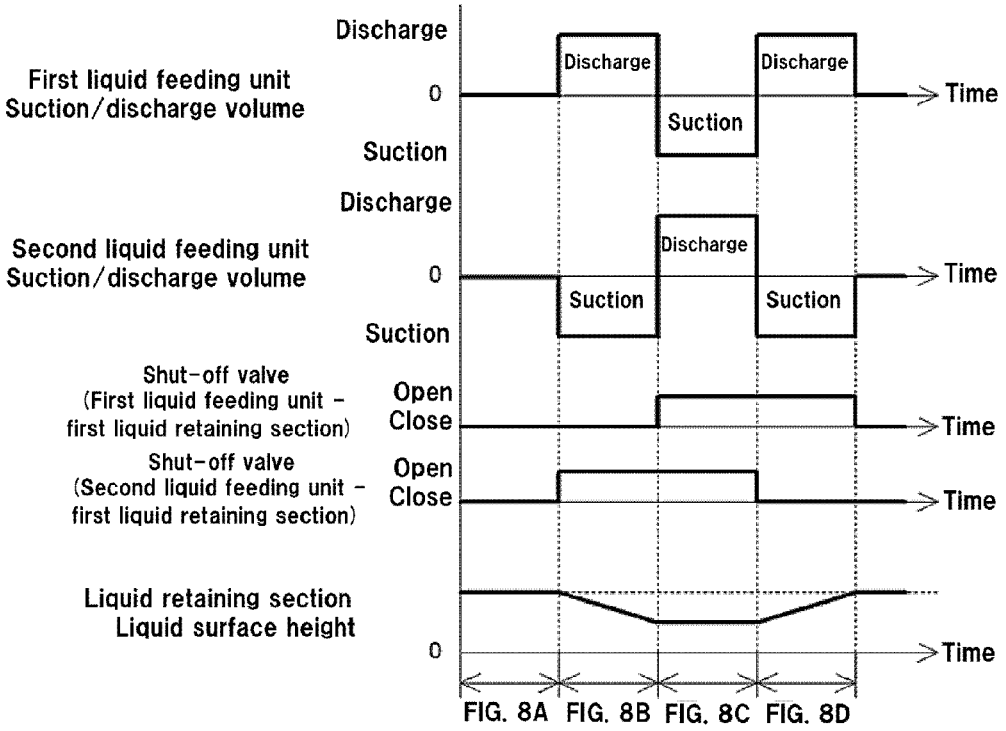
FIG. 9 is an explanatory diagram presenting one example of a change of a liquid surface height within a first liquid retaining section when the operations presented in FIGS. 8A to 8D are performed.

FIG. 9 is an explanatory diagram presenting one example of a change of a liquid surface height within a first liquid retaining section when the operations presented in FIGS. 8A to 8D are performed.

Even when the first liquid feeding unit 201 and the second liquid feeding unit 202, which are connected to the first liquid retaining section 141, continuously perform the discharge and suction operations, it is possible to control a liquid surface height within the first liquid retaining section 141 by switching the open state and the close state of the shut-off valve 311 provided at the flow path 211 connecting the first liquid retaining section 141 and the first liquid feeding unit 201 and switching the open state and the close state of the shut-off valve 321 provided at the flow path 221 connecting the first liquid retaining section 141 and the first liquid feeding unit 202.

Figure 10:
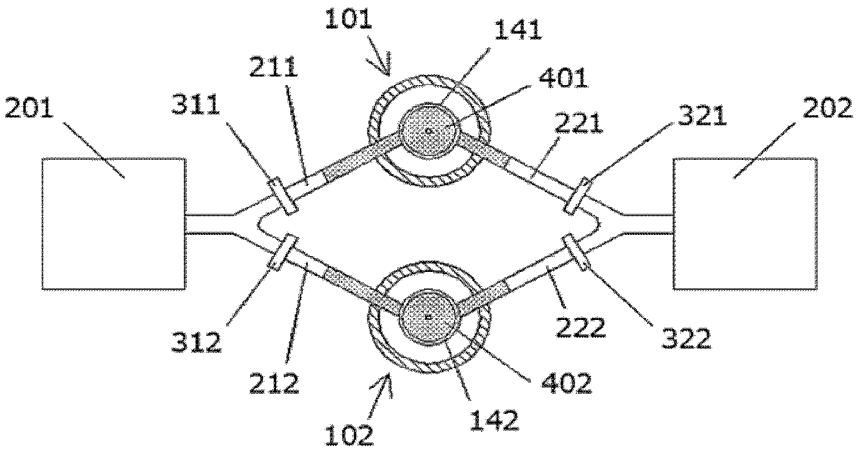
FIG. 10 is a plan view presenting another example of a liquid discharge device of the present disclosure.

FIG. 10 is a plan view presenting another example of a liquid discharge device of the present disclosure. A liquid discharge device 500 presented in FIG. 10 includes two liquid discharge heads and liquid retaining and stirring units 200.

A first liquid discharge head 101 includes a first liquid retaining section 141 configured to retain a solution 401. The first liquid retaining section 141 is connected to a first liquid feeding unit 201 via a flow path 211, and is connected to a second liquid feeding unit 202 via a flow path 221. The flow path 211 is provided with a shut-off valve 311, and the flow path 221 is provided with a shut-off valve 321.

A second liquid discharge head 102 includes a second liquid retaining section 142 configured to retain a solution 402. The second liquid retaining section 142 is connected to the first liquid feeding unit 201 via a flow path 212, and is connected to the second liquid feeding unit 202 via a flow path 222.

Figure 11:
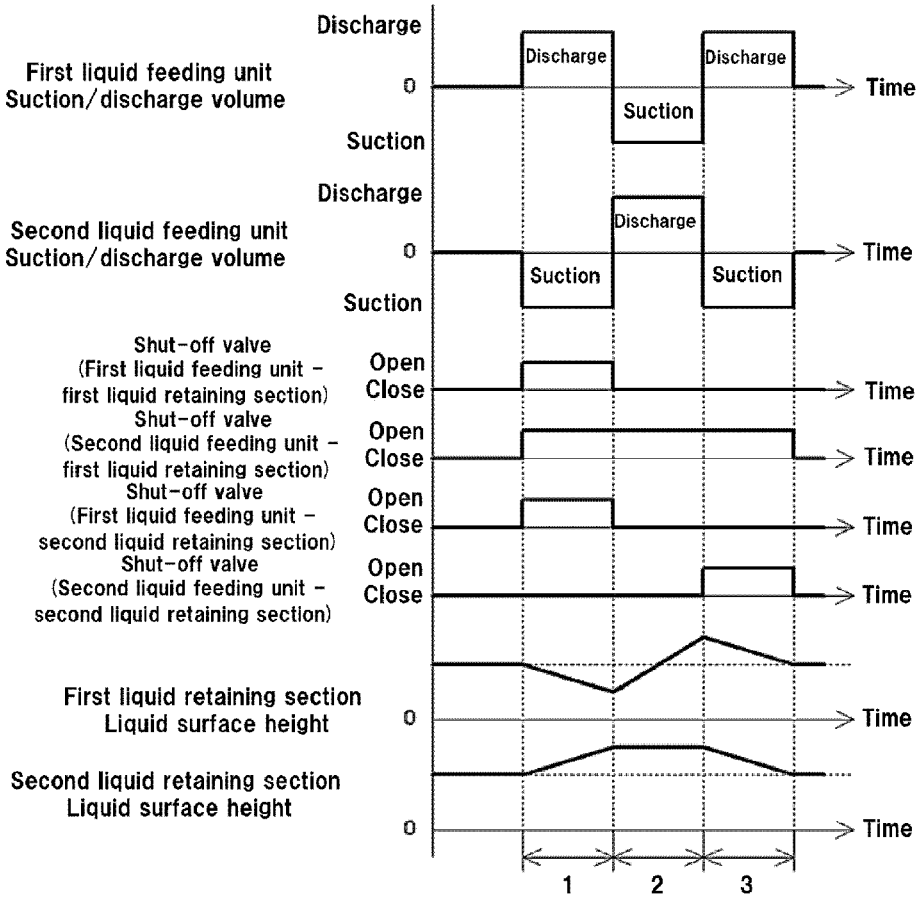
FIG. 11 is an explanatory diagram presenting one example of a change of liquid surface heights within a first liquid retaining section and a second liquid retaining section when discharge and suction operations of a first liquid feeding unit and a second liquid feeding unit and switching an open state and a close state of all shut-off valves provided at flow paths are controlled in the liquid discharge device presented in FIG. 10.

FIG. 11 is an explanatory diagram presenting one example of a change of liquid surface heights within a first liquid retaining section and a second liquid retaining section when discharge and suction operations of a first liquid feeding unit and a second liquid feeding unit and switching an open state and a close state of all shut-off valves provided at flow paths are controlled in the liquid discharge device presented in FIG. 10.

In an area indicated by 1 in FIG. 11, the shut-off valve 322 provided at the flow path 222 connecting the second liquid feeding unit 202 with the second liquid retaining section 142 is closed, and the other shut-off valves are opened. At this time, the second liquid feeding unit 202 does not suck the solution 402 within the second liquid retaining section 142. Instead of this, the suction volume of the solution 401 within the first liquid retaining section 141 is increased due to the second liquid feeding unit 202. Therefore, because the liquid volume of the solution 401 sucked by the second liquid feeding unit 202 is larger than the liquid volume of the solution 401 discharged by the first liquid feeding unit 201, the liquid surface height within the first liquid retaining section 141 falls.

Meanwhile, because only the discharge operation is performed by the first liquid feeding unit 141, the liquid volume is increased, and the liquid surface height of the solution 402 within the second liquid retaining section 142 rises.

In an area indicated by 2 in FIG. 11, only the shut-off valve 321 provided at the flow path 221 connecting the second liquid feeding unit 202 with first liquid retaining section 141 is opened, and the other shut-off valves are closed. At this time, the liquid volume of the solution 402 within the second liquid retaining section 142 does not change because the first liquid feeding unit 201 does not perform the suction operation and the second liquid feeding unit 202 does not perform the discharge operation. Therefore, the liquid surface height does not change.

Meanwhile, the solution 402 is discharged by the second liquid feeding unit 202 within the first liquid retaining section 141. However, the discharged liquid volume is increased by such a volume that is not discharged into the second liquid retaining section 142 by the second liquid feeding unit 202. Therefore, the liquid surface height considerably rises.

In an area indicated by 3 in FIG. 11, the shut-off valve 321 provided at the flow path 221 connecting the second liquid feeding unit 202 with the first liquid retaining section 141 and the shut-off valve 322 provided at the flow path 222 connecting the second liquid feeding unit 202 with the second liquid retaining section 142 are opened, and the other shut-off valves are closed. At this time, the solution 401 and the solution 402 are not discharged into the first liquid retaining section 141 and the second liquid retaining section 142 by the first liquid feeding unit 201.

Meanwhile, because the second liquid feeding unit 202 performs the suction within the first liquid retaining section 141 and the second liquid retaining section 142, both the liquid volume of the solution 401 within the first liquid retaining section 141 and the liquid volume of the solution 402 within the second liquid retaining section 142 are decreased, and both liquid surface heights also fall.

As presented in FIG. 11, even when the first liquid feeding unit 201 and the second liquid feeding unit 202 continuously perform the discharge and suction operations, it is possible to control the liquid surface heights within the first liquid retaining section 141 and the second liquid retaining section 142, by switching the open state and the close state of the shut-off valves 311 and 321 provided at the flow paths 211 and 221, respectively, and switching the open state and the close state of the shut-off valves 312 and 322 provided at the flow paths 212 and 222, respectively.

Here, as presented in FIG. 10, the liquid retaining section 141 of the first liquid discharge head 101 and the first liquid feeding unit 201 are connected via the flow path 211, and the liquid retaining section 142 of the second liquid discharge head 102 and the first liquid feeding unit 201 are connected via the flow path 212. Meanwhile, the liquid retaining section 141 of the first liquid discharge head 101 and the second liquid feeding unit 202 are connected via the flow path 221, and the liquid retaining section 142 of the second liquid discharge head 102 and the second liquid feeding unit 202 are connected via the flow path 222.

In another embodiment of the present disclosure, an inner diameter, length, and shape of the flow paths are set so that the liquid volume, which is discharged into the first liquid retaining section 141 and is sucked from the first liquid retaining section 141 via the flow path 211 by the first liquid feeding unit 201, and the liquid volume, which is discharged into the first liquid retaining section 141 and is sucked from the first liquid retaining section 141 via the flow path 221 by the second liquid feeding unit 202, are the same, and so that the liquid volume, which is discharged into the first liquid retaining section 142 and is sucked from the first liquid retaining section 141 via the flow path 212 by the first liquid feeding unit 201, and the liquid volume, which is discharged into the first liquid retaining section 141 and is sucked from the first liquid retaining section 141 via the flow path 221 by the second liquid feeding unit 202, are the same. However, arrangement of the flow paths is preferably set so that the flow paths are symmetrically disposed with respect to a face penetrating through a center of the first liquid retaining section 141 and a center of the second liquid retaining section 142.

Figure 12:
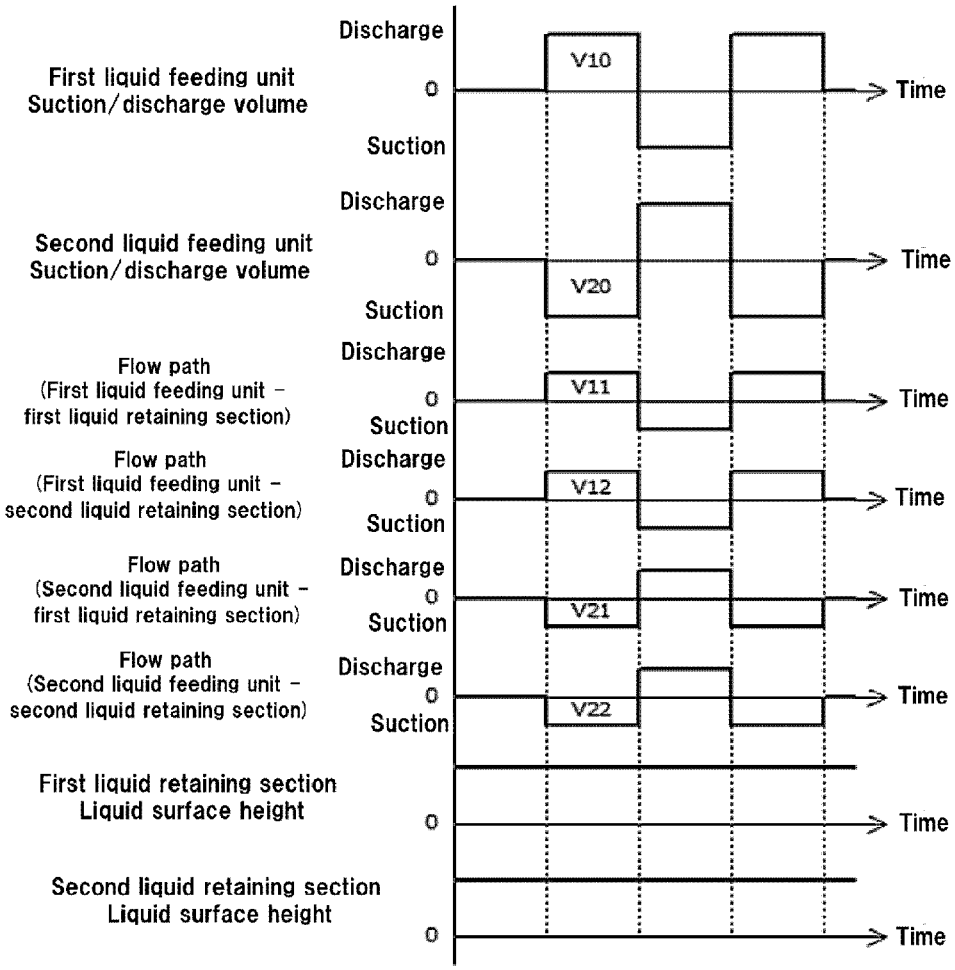
FIG. 12 is an explanatory diagram presenting one example of a change of discharge/suction liquid volume via each flow path and a liquid surface height of a solution within each liquid retaining section when a first liquid feeding unit and a second liquid feeding unit perform discharge and suction operations.

FIG. 12 is an explanatory diagram presenting one example of a change of discharge/suction liquid volume via each flow path and a liquid surface height of a solution within each liquid retaining section when a first liquid feeding unit and a second liquid feeding unit perform discharge and suction operations. Note that, all the shut-off valves are always opened.

When the first liquid feeding unit 201 performs the discharge operation, a discharge volume V10 of the first liquid feeding unit is divided into a liquid volume V11 discharged into the first liquid retaining section 141 via the flow path 211 and a liquid volume V12 discharged into the second liquid retaining section 142 via the flow path 212. Meanwhile, when the suction operation of the second liquid feeding unit 202 is performed in synchronization with the first liquid feeding unit 201, a suction volume V20 of the second liquid feeding unit is divided into a liquid volume V21 sucked from the first liquid retaining section 141 via the flow path 221 and a liquid volume V22 sucked from the second liquid retaining section 142 via the flow path 222.

In the case presented in FIG. 12, the liquid volume V11 discharged into the first liquid retaining section 141 via the flow path 211 and the liquid volume V21 sucked from the first liquid retaining section 141 via the flow path 221 are the same, and the liquid volume V12 discharged into the second liquid retaining section 142 via the flow path 212 and the liquid volume V22 sucked from the second liquid retaining section 142 via the flow path 222 are the same. Therefore, the liquid surface height of the solution 401 within the first liquid retaining section 141 and the liquid surface height of the solution 402 within the second liquid retaining section 142 can be kept constant.

Figure 13:
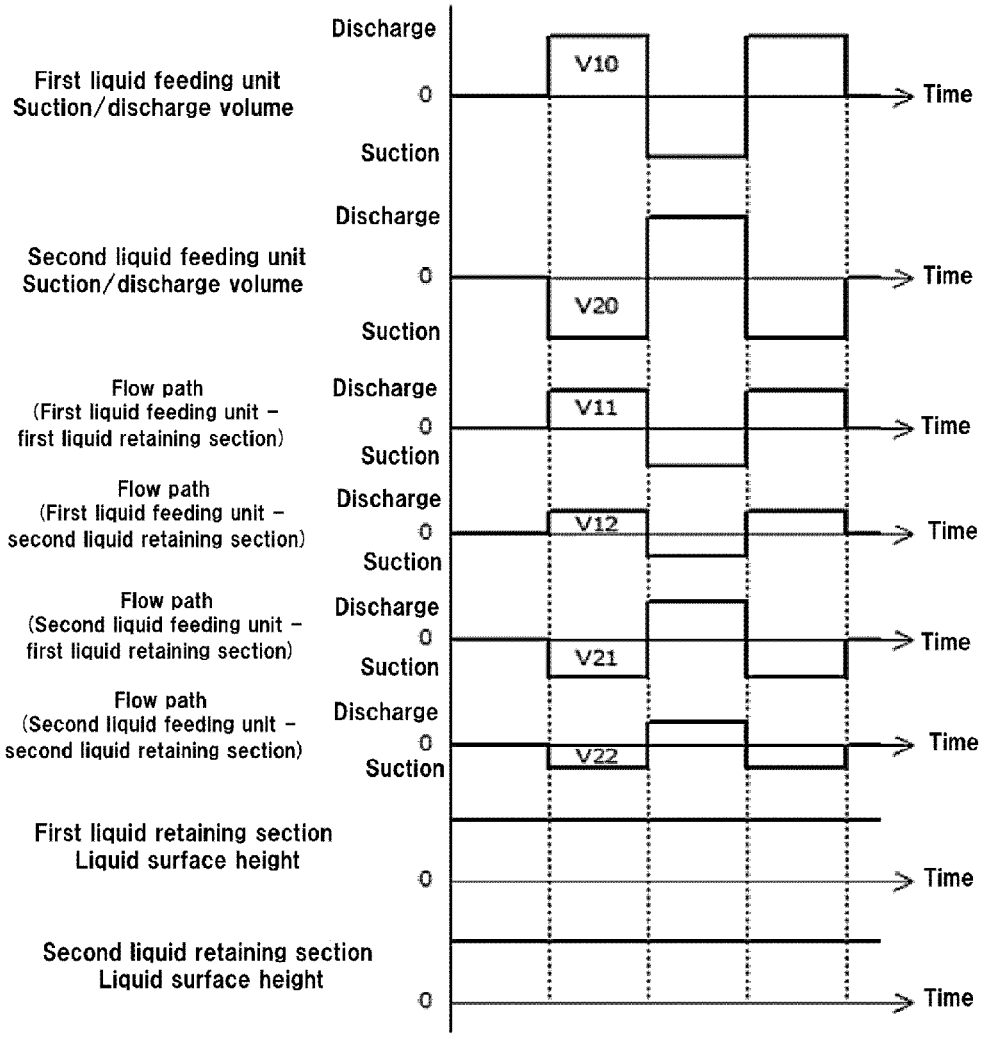
FIG. 13 is an explanatory diagram presenting another example of a change of discharge/suction liquid volume via each flow path and a liquid surface height of a solution within each liquid retaining section when a first liquid feeding unit and a second liquid feeding unit perform discharge and suction operations.

FIG. 13 is an explanatory diagram presenting another example of a change of discharge/suction liquid volume via each flow path and a liquid surface height of a solution within each liquid retaining section when a first liquid feeding unit and a second liquid feeding unit perform discharge and suction operations. Note that, all the shut-off valves are always opened.

When the discharge operation of the first liquid feeding unit 201 is performed, a discharge volume V10 of the first liquid feeding unit is divided into a liquid volume V11 discharged into the first liquid retaining section 141 via the flow path 211 and a liquid volume V12 discharged into the second liquid retaining section 142 via the flow path 212. Meanwhile, when the suction operation of the second liquid feeding unit 202 is performed in synchronization with the first liquid feeding unit 201, a suction volume V20 of the second liquid feeding unit is divided into a liquid volume V21 sucked from the first liquid retaining section 141 via the flow path 221 and a liquid volume V22 sucked from the second liquid retaining section 142 via the flow path 222.

In the case presented in FIG. 13, the liquid volume V11 discharged into the first liquid retaining section 141 via the flow path 211 by the first liquid feeding unit 201 and the liquid volume V12 discharged into second liquid retaining section 142 via the flow path 212 by the first liquid feeding unit 201 are different. Moreover, the liquid volume V21 sucked from the first liquid retaining section 141 via the flow path 221 by the second liquid feeding unit 202 and the liquid volume V22 sucked from the second liquid retaining section 142 via the flow path 222 by the second liquid feeding unit 202 are different. Therefore, while the liquid surface height of the solution 401 within the first liquid retaining section 141 and the liquid surface height of the solution 402 within the second liquid retaining section 142 are kept constant, it is possible to generate a difference between a stirring force of the solution 401 within the first liquid retaining section 141 and a stirring force of the solution 402 within the second liquid retaining section 142.

The discharge/suction volume required for stirring a solution (dispersion of particles) through the discharge and suction operations of the liquid feeding unit varies depending on a kind of particles contained in the solution. Therefore, it is preferable that a solution containing particles requiring larger stirring force be set on a liquid retaining section having a larger discharge/suction volume performed by a liquid feeding unit.

Figure 14:
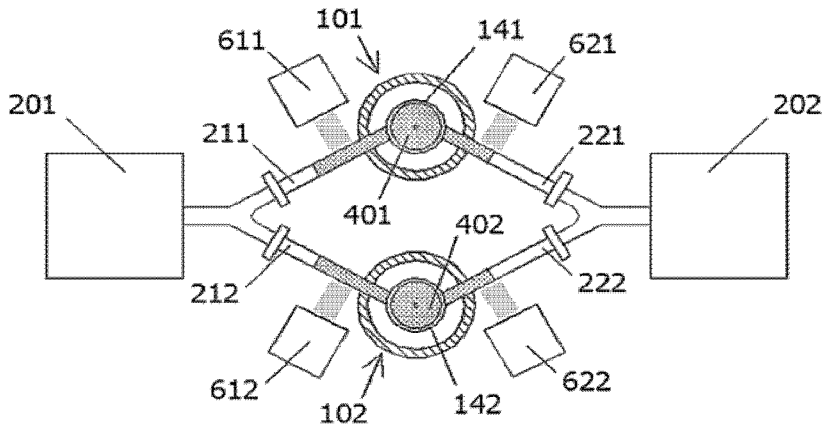
FIG. 14 is a plane view presenting another example of a liquid discharge device of the present disclosure.

FIG. 14 is a plane view presenting another example of a liquid discharge device of the present disclosure.

A liquid discharge device 500 presented in FIG. 14 includes two liquid discharge heads and liquid retaining and stirring units 200. A first liquid discharge head 101 includes a first liquid retaining section 141 configured to retain a solution 401. The first liquid retaining section 141 is connected to a first liquid feeding unit 201 via a flow path 211, and is connected to a second liquid feeding unit 202 via a flow path 221. The flow path 211 is provided with a volume detection unit 611, and the flow path 221 is provided with a volume detection unit 621.

Meanwhile, a second liquid discharge head 102 includes a second liquid retaining section 142 configured to retain a solution 402. The second liquid retaining section 142 is connected to the first liquid feeding unit 201 via a flow path 212, and is connected to the second liquid feeding unit 202 via a flow path 222. The flow path 212 is provided with a volume detection unit 612, and the flow path 222 is provided with a volume detection unit 622.

Each volume detection unit as a volume detection section always detects a solution volume discharged and sucked via each flow path, and the detection results obtained are fed back into a controller 160 of the first liquid feeding unit 201 and the second liquid feeding unit 202.

Preferable examples of the volume detection unit include flowmeters through an image sensor or ultrasonic waves. The flow path may be provided with a mass-type volume detector or a volume-type volume detector.

When an image sensor is used as the volume detection unit, at least an area of each flow path where a volume is detected is required to be transparent.

The liquid discharge device as presented in FIG. 14 can keep the liquid surface height of a solution constant within each liquid retaining section because the liquid volume discharged into/sucked from each liquid retaining section by the first liquid feeding unit 201 and the second liquid feeding unit 202 is accurate.

At least one flow path connected to one liquid feeding unit among flow paths may retain a predetermined volume of liquid in advance. In this case, as the predetermined volume, a volume that is similar to or larger than the liquid volume discharged/sucked by each liquid feeding unit for the purpose of stirring the solution (dispersion of particles) within the liquid retaining section is set. In addition, the flow path in which the predetermined volume of liquid is retained in advance is disposed at a side of the liquid feeding unit that performs the discharge operation into the liquid retaining section first. The flow path at a side of the liquid feeding unit that performs the suction operation from the liquid retaining section first may retain the liquid in advance. However, the volume thereof is preferably smaller than the liquid volume retained at the flow path at a side of the liquid feeding unit that performs the discharge operation into the liquid retaining section first.

In addition, the liquid volume retained within the flow path in advance and the liquid volume discharged and sucked by each liquid feeding unit may be set so that the solution discharged into/sucked from each liquid retaining section by the first liquid feeding unit and the second liquid feeding unit does not pass through the shut-off valve. In this case, it is necessary to satisfy the following expression: $Vp \geq Vr + Vea$, where Vp is the volume of the flow path from the liquid retaining section to the shut-off valve, Vr is the liquid volume retained within the flow path in advance, and Vea is the liquid volume discharged/sucked by each liquid feeding unit. This makes it possible to prevent solutions retained within liquid retaining sections from being mixed even when the solutions retained within liquid retaining sections are different.

Next, a procedure for allowing a liquid surface height within a liquid retaining section to return to a standard when the liquid surface height within the liquid retaining section is lower than the standard at an initial point will be described.

Figure 15:
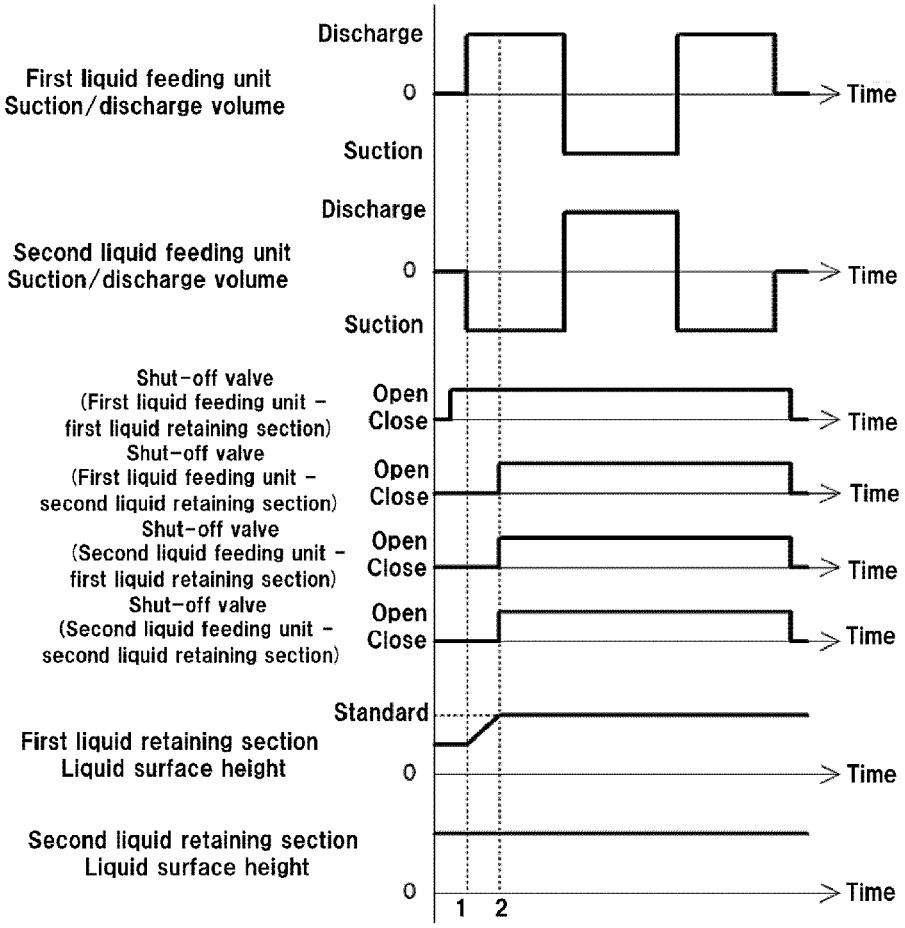
FIG. 15 is an explanatory diagram presenting one example of a change of a liquid surface height in allowing a liquid surface height within a liquid retaining section to return to a standard when the liquid surface height within the liquid retaining section is lower than the standard.

FIG. 15 is an explanatory diagram presenting one example of a change of a liquid surface height in allowing a liquid surface height within a liquid retaining section to return to a standard when the liquid surface height within the liquid retaining section is lower than the standard.

In 1 in FIG. 15, when a liquid surface detection unit detects a liquid surface height within the liquid retaining section being lower than a standard, only the shut-off valve, which is provided at the flow path that performs the discharge operation first among the flow paths connected to the liquid retaining sections, is opened. Moreover, the other shut-off valves are closed, and the first liquid feeding unit and the second liquid feeding unit start discharge and suction operations. At this time, only the discharge by the liquid feeding unit is performed in the liquid retaining section within which the liquid surface height is lower than the standard. Therefore, the liquid surface height within the liquid retaining section rises.

In 2 in FIG. 15, when the liquid surface detection unit detects a liquid surface height within the liquid retaining section returning to the standard, all the shut-off valves closed during the discharge and suction operations of the first liquid feeding unit and the second liquid feeding unit are switched to the open state. At this time, the liquid surface height within each liquid retaining section is a standard height. Thereinafter, the discharge and suction operations of the first liquid feeding unit are performed in synchronization with the discharge and suction operations of the second liquid feeding unit. Therefore, the liquid surface height is kept constant.

Next, a procedure for allowing a liquid surface height within the liquid retaining section to return to a standard when the liquid surface heights within a plurality of liquid retaining sections are lower than the standard at an initial point will be described.

Figure 16:
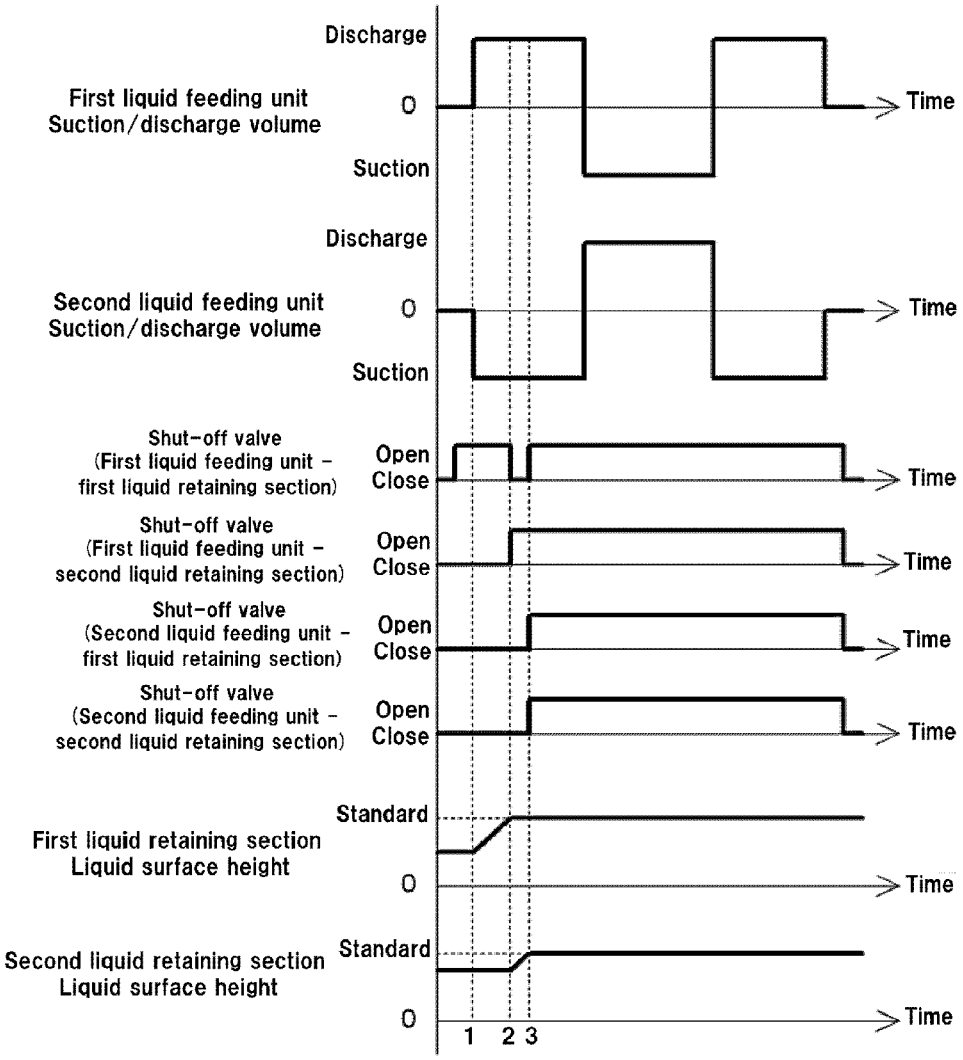
FIG. 16 is an explanatory diagram presenting one example of a change of a liquid surface height in allowing a liquid surface height within a liquid retaining section to return to a standard when liquid surface heights within a plurality of liquid retaining sections are lower than the standard.

FIG. 16 is an explanatory diagram presenting one example of a change of a liquid surface height in allowing a liquid surface height within a liquid retaining section to return to a standard when liquid surface heights within a plurality of liquid retaining sections are lower than the standard.

In 1 in FIG. 16, when the liquid surface detection unit detects liquid surface heights within a plurality of liquid retaining sections being lower than a standard, only the shut-off valve, which is provided at a flow path at a side of the liquid feeding unit that performs the discharge operation first in flow paths connected to one liquid retaining section of the plurality of liquid retaining sections, is opened. Moreover, the other shut-off valves are closed, and the first liquid feeding unit and the second liquid feeding unit start discharge and suction operations. At this time, only the discharge by the liquid feeding unit is performed in one liquid retaining section within which the liquid surface height is lower than the standard. Therefore, the liquid surface height within the liquid retaining section rises.

In 2 in FIG. 16, when the liquid surface detection unit detects a liquid surface height within the liquid retaining section returning to the standard, only the shut-off valve, which is provided at the flow path at a side of the liquid feeding unit that performs the discharge operation among the flow paths connected to the other liquid retaining section within which the liquid surface height is lower than the standard, is opened, and the other shut-off valves are switched to the close state. At this time, only the discharge by the liquid feeding unit is performed again in the liquid retaining section within which the liquid surface height is lower than the standard. Therefore, the liquid surface height of the liquid retaining section rises.

When the liquid surface detection units detect liquid surface heights within all the liquid retaining sections returning to the standard, all the closed shut-off valves are switched to the open state. At this time, the liquid surface heights within all the liquid retaining sections reach the standard height. Thereinafter, the discharge and suction operations of the first liquid feeding unit are performed in synchronization with the discharge and suction operations of the second liquid feeding unit. Therefore, the liquid surface height is kept constant.

Next, another procedure for allowing liquid surface heights within a plurality of liquid retaining sections to return to a standard when the liquid surface heights within the liquid retaining sections are lower than the standard at an initial point will be described.

Figure 17:
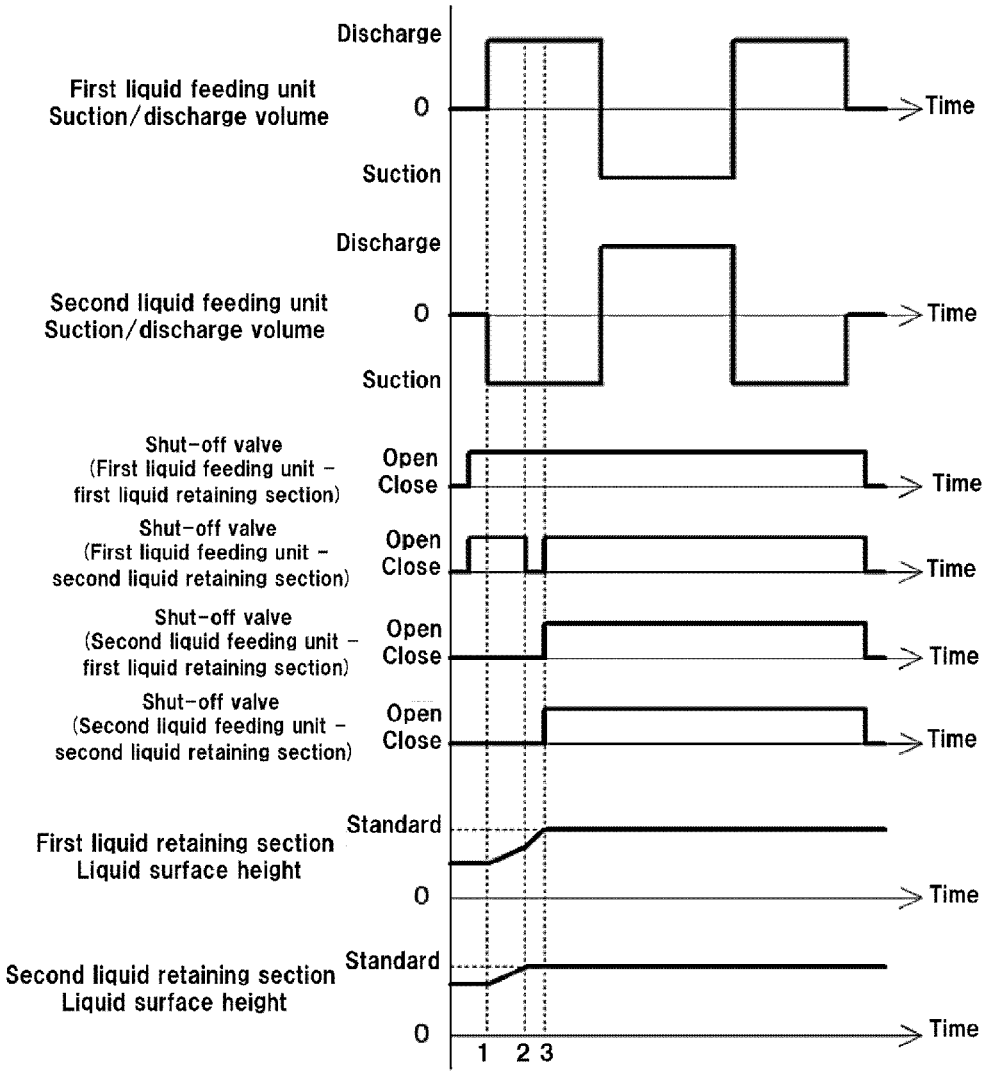
FIG. 17 is an explanatory diagram presenting another example of a change of a liquid surface height in allowing a liquid surface height within a liquid retaining section to return to a standard when liquid surface heights within a plurality of liquid retaining sections are lower than the standard.

FIG. 17 is an explanatory diagram presenting another example of a change of a liquid surface height in allowing a liquid surface height within a liquid retaining section to return to a standard when liquid surface heights within a plurality of liquid retaining sections are lower than the standard.

In 1 in FIG. 17, when each liquid surface detection unit detects liquid surface heights within a plurality of liquid retaining sections being lower than a standard, only the shut-off valves, which are provided at flow paths at a side of the liquid feeding unit that performs the discharge operation first in flow paths connected to the liquid retaining section of the plurality of liquid retaining sections, are opened. Moreover, the other shut-off valves are closed, and the first liquid feeding unit and the second liquid feeding unit start discharge and suction operations. At this time, only the discharge by the liquid feeding unit is performed in the liquid retaining sections within which the liquid surface height is lower than the standard. Therefore, the liquid surface heights within the liquid retaining sections rise.

In 2 in FIG. 17, when the liquid surface detection unit detects a liquid surface height within any one of liquid retaining sections returning to the standard, the shut-off valve, which is provided at the flow path connected to the liquid retaining section within which the liquid surface height returns to the standard, is switched to the close state. At this time, only the discharge by the liquid feeding unit is performed in the liquid retaining section within which the liquid surface height is still lower than the standard. Therefore, the liquid surface height within the liquid retaining section rises.

When the liquid surface detection units detect liquid surface heights within all the liquid retaining sections returning to the standard, all the closed shut-off valves are switched to the open state. At this time, the liquid surface heights within all the liquid retaining sections reach the standard height. Thereinafter, the discharge and suction operations of the first liquid feeding unit are performed in synchronization with the discharge and suction operations of the second liquid feeding unit. Therefore, the liquid surface height is kept constant.

Next, a procedure for allowing a liquid surface height within a liquid retaining section to return to a standard when the liquid surface height within the liquid retaining section is lower than the standard at an initial point will be described. Note that, the device is the same as that of FIG. 10.

Figure 18:
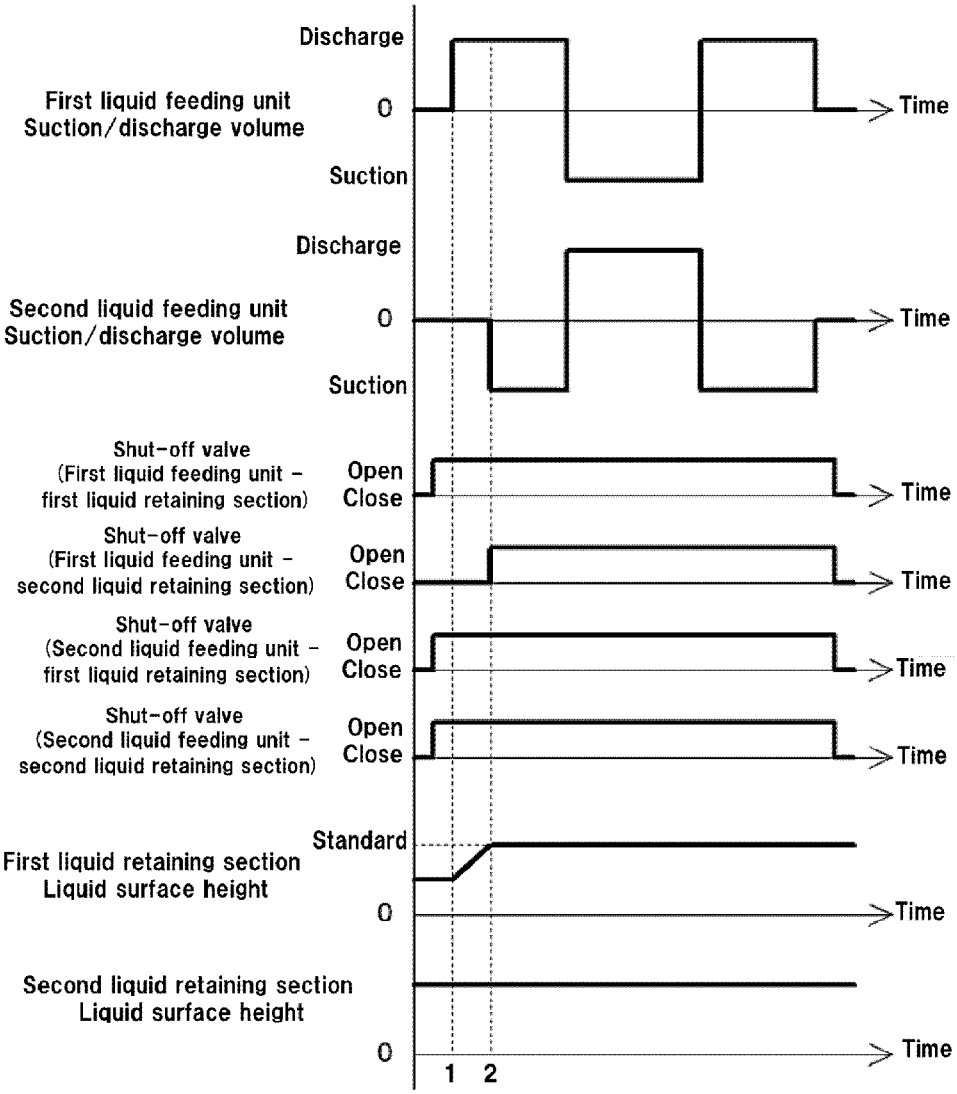
FIG. 18 is an explanatory diagram presenting another example of a change of a liquid surface height in allowing a liquid surface height within a liquid retaining section to return to a standard when the liquid surface height within the liquid retaining section is lower than the standard.

FIG. 18 is an explanatory diagram presenting another example of a change of a liquid surface height in allowing a liquid surface height within a liquid retaining section to return to a standard when the liquid surface height within the liquid retaining section is lower than the standard.

In 1 in FIG. 18, when a liquid surface detection unit detects a liquid surface height within the liquid retaining section being lower than a standard, only the shut-off valve, which is provided at the flow path that performs the suction operation first among the flow paths connected to the liquid retaining section within which the liquid surface height reaches the standard height, is closed. Moreover, the other shut-off valves are opened, and the first liquid feeding unit and the second liquid feeding unit start discharge and suction operations. At this time, only the discharge by the liquid feeding unit is performed in the liquid retaining section within which the liquid surface height is lower than the standard. Therefore, the liquid surface height within the liquid retaining section rises.

In 2 in FIG. 18, when the liquid surface detection unit detects the liquid surface height within the liquid retaining section returning to the standard, the first liquid feeding unit or the second liquid feeding unit starts the suction operation, and all the closed shut-off valves are switched to the open state. At this time, the liquid surface height within each liquid retaining section reaches the standard height. Thereinafter, the discharge and suction operations of the first liquid feeding unit are performed in synchronization with the discharge and suction operations of the second liquid feeding unit. Therefore, the liquid surface height is kept constant.

Next, a procedure for allowing a liquid surface height within a liquid retaining section to return to a standard when the liquid surface height within the liquid retaining section is lower than the standard at an initial point will be described. Note that, the device is the same as that of FIG. 10.

Figure 19:
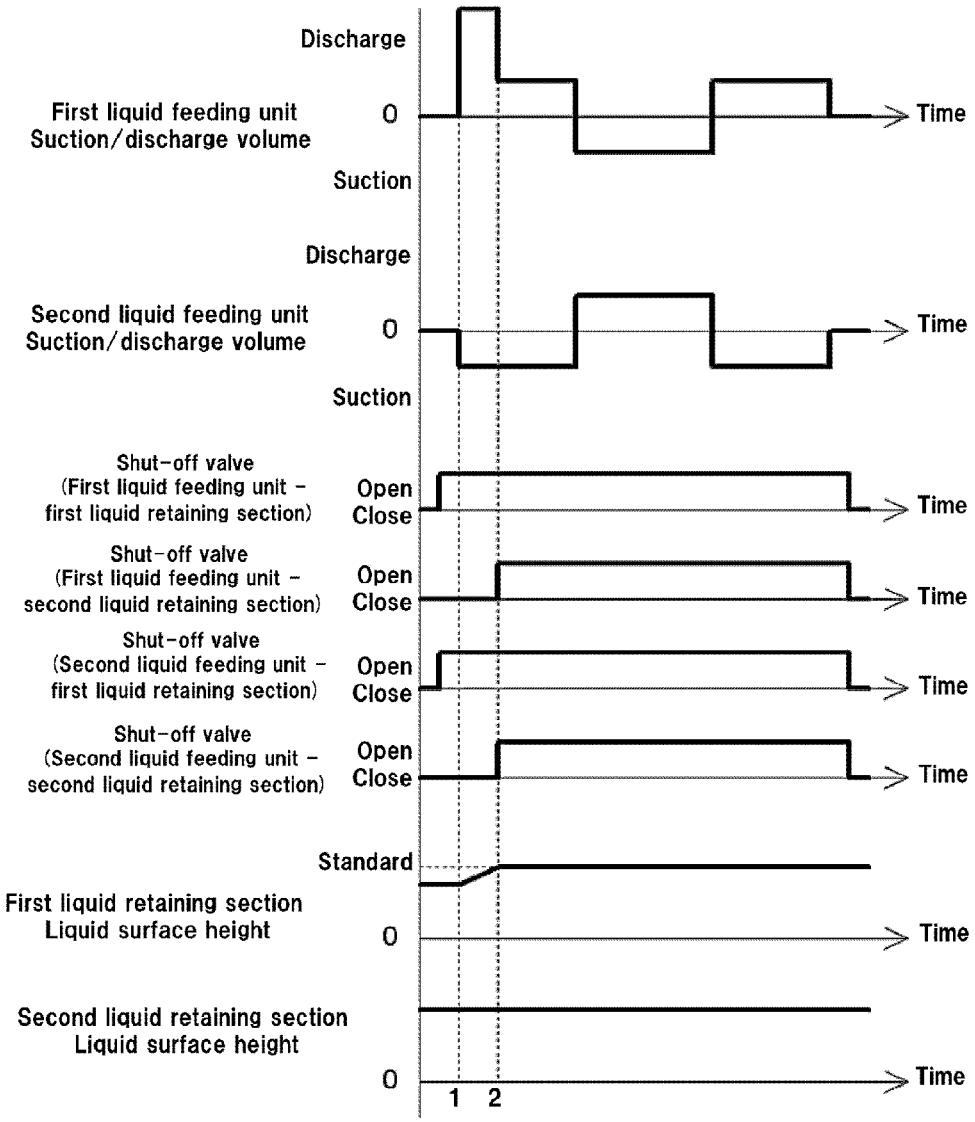
FIG. 19 is an explanatory diagram presenting another example of a change of a liquid surface height in allowing a liquid surface height within a liquid retaining section to return to a standard when the liquid surface height within the liquid retaining section is lower than the standard.

FIG. 19 is an explanatory diagram presenting another example of a change of a liquid surface height in allowing a liquid surface height within a liquid retaining section to return to a standard when the liquid surface height within the liquid retaining section is lower than the standard.

In 1 in FIG. 19, when the liquid surface detection unit detects a liquid surface height within a liquid retaining section being lower than a standard, shut-off valves, which are provided at flow paths connected to the liquid retaining section within which the liquid surface height reaches the standard height, are closed. Moreover, the other shut-off valves are opened, and the first liquid feeding unit and the second liquid feeding unit start discharge and suction operations. The discharge volume by the first liquid feeding unit or the second liquid feeding unit is set to be larger than the suction volume by the other liquid feeding unit. At this time, the discharge and suction operations are performed by the liquid feeding unit in the liquid retaining section within which the liquid surface height is lower than the standard. However, because the discharge volume is larger than the suction volume, the liquid surface height within the liquid retaining section rises.

In 2 in FIG. 19, when the liquid surface detection unit detects the liquid surface height within the liquid retaining section returning to the standard, the first liquid feeding unit or the second liquid feeding unit starts the suction operation, and all the closed shut-off valves are switched to the open state. At this time, the liquid surface height within each liquid retaining section reaches the standard height. Thereinafter, the discharge and suction operations of the first liquid feeding unit are performed in synchronization with the discharge and suction operations of the second liquid feeding unit. Therefore, the liquid surface height is kept constant.

(Dispensing Device)

A dispensing device includes a liquid discharge device 100 of the present disclosure and a target to be impacted configured to house liquid discharged from the liquid discharge device 100, and may further include a controller and other units if necessary.

<Target to be Impacted>

The target to be impacted is a member in which a plurality of recessed portions on which droplets discharged from a liquid discharge head of a liquid discharge device are impacted are formed.

A material, shape, size, and structure of the target to be impacted are not particularly limited and may be appropriately selected depending on the intended purpose, so long as droplets discharged can adhere to the target to be impacted.

The material of the target to be impacted is not particularly limited and may be appropriately selected depending on the intended purpose. Suitable examples thereof include those made of, for example, semiconductors, ceramics, metals, glass, quartz glass, and plastics.

The shape of the target to be impacted is not particularly limited and may be appropriately selected depending on the intended purpose. Examples thereof include a board shape and a plate shape.

The structure of the target to be impacted is not particularly limited and may be appropriately selected depending on the intended purpose. The structure thereof may be, for example, a single-layer structure or a multi-layer structure.

The number of the recessed portions provided in the target to be impacted is plural, preferably two or more, more preferably five or more, still more preferably 50 or more.

The other units are not particularly limited and may be appropriately selected depending on the intended purpose.

The dispensing device of the present disclosure includes the liquid discharge device of the present disclosure. Therefore, when a solution is a cell suspension, the dispensing device is suitably used for well preparation that can be widely used in various fields such as evaluation of safety and efficacy of regenerative medicine, medicines, cosmetics, and chemical substances.

As described above, the liquid discharge head of the present disclosure includes a liquid discharge unit, which includes a discharge port, a liquid retaining section configured to retain liquid to be discharged from the discharge port, and a displacement section configured to discharge the liquid retained within the liquid retaining section from the discharge port. In addition, the liquid discharge head includes a pair of liquid storage sections, which are configured to store the liquid and are each connected to the liquid retaining section in the liquid discharge unit so that the liquid can flow; and a pair of liquid feeding sections that are connected to the pair of liquid storage sections and are configured to feed the liquid between the liquid storage section and the liquid retaining section. The liquid discharge head includes a pair of open and close sections that are each disposed at a flow path between the liquid feeding section and the liquid storage section and are configured to open and close the flow path. As a result, the feeding of the liquid can be securely performed, and the liquid surface height within the liquid retaining section can be easily kept constant, which results in stable discharge.

Aspects of the present disclosure are as follows, for example.

<1> A liquid discharge head including:

a liquid discharge unit, which includes a discharge port, a liquid retaining section configured to retain liquid to be discharged from the discharge port, and a displacement section configured to discharge the liquid retained within the liquid retaining section from the discharge port;

a pair of liquid storage sections, which are configured to store the liquid and are each connected to the liquid retaining section in the liquid discharge unit so that the liquid can flow;

a pair of liquid feeding sections that are connected to the pair of liquid storage sections and are configured to feed the liquid between the liquid storage section and the liquid retaining section; and a pair of open and close sections that are each disposed at a flow path between the liquid feeding section and the liquid storage section and are configured to open and close the flow path.

<2> The liquid discharge head according to <1>, wherein the liquid discharge unit further includes a liquid surface detection section configured to detect liquid surface height within the liquid retaining section, opening and closing the pair of open and close sections is controlled based on detection results of the liquid surface height provided by the liquid surface detection section.

<3> The liquid discharge head according to <1> or <2>, wherein the pair of liquid feeding sections feed the liquid stored in one liquid storage section to the liquid retaining section while feeding the liquid from the liquid retaining section to other liquid storage section.

<4> The liquid discharge head according to any one of <1> to <3>, further including a controller configured to control at least one selected from the group consisting of the pair of liquid feeding sections and the pair of open and close sections so that liquid surface height within the liquid retaining section is constant.

<5> The liquid discharge head according to any one of <1> to <4>, wherein the liquid discharge head includes:

a plurality of the liquid discharge units;

the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections; and the pairs of open and close sections that are same in number as the pairs of liquid storage sections, wherein control of the pairs of open and close sections that are same in number as the pairs of liquid feeding sections and the pairs of liquid storage sections selectively feeds the liquid within at least one liquid retaining section in the plurality of the liquid discharge units.

<6> The liquid discharge head according to <5>, wherein the control is performed so that volume of the liquid to be fed from the at least one liquid retaining section is different from volume of the liquid to be fed from other liquid retaining sections.

<7> The liquid discharge head according to any one of <1> to <6>, further including a volume detection section configured to detect volume of the liquid in the liquid storage section, wherein at least one selected from the group consisting of the pair of liquid feeding sections and the pair of open and close sections is controlled based on detection results of the volume detection section.

<8> The liquid discharge head according to any one of <1> to <7>, wherein the liquid is stored in advance in at least one of the pair of liquid storage sections.

<9> The liquid discharge head according to any one of <1> to <8>, wherein when liquid volume of the liquid within the liquid retaining section is smaller than a predetermined value, control for feeding the liquid from at least one of the pair of liquid storage sections to the liquid retaining section is performed.

<10> The liquid discharge head according to any one of <1> to <9>, wherein control is performed so that the liquid is not fed to a side of the liquid feeding section beyond the open and close section.

<11> The liquid discharge head according to any one of <1> to <10>, wherein the liquid includes particles.

<12> A liquid discharge device including the liquid discharge head according to any one of <1> to <11>.

<13> A dispensing device including:

the liquid discharge device according to <12>; and a target to be impacted configured to house liquid discharged by the liquid discharge device.

<14> A liquid discharge method capable of discharging liquid, the liquid discharge method including:

with a liquid discharge unit, which includes a discharge port, a liquid retaining section configured to retain liquid to be discharged from the discharge port, and a displacement section configured to discharge the liquid retained within the liquid retaining section from the discharge port, storing the liquid with a pair of liquid storage sections, which are configured to store the liquid and are each connected to the liquid retaining section in the liquid discharge unit so that the liquid can flow;

feeding the liquid between the liquid storage section and the liquid retaining section with a pair of liquid feeding sections that are connected to the pair of liquid storage sections and are configured to feed the liquid between the liquid storage section and the liquid retaining section;

opening and closing a flow path with a pair of open and close sections that are each disposed at the flow path between the liquid feeding section and the liquid storage section and are configured to open and close the flow path.

<15> The liquid discharge method according to <14>, wherein the liquid discharge unit further includes a liquid surface detection section configured to detect liquid surface height within the liquid retaining section, and opening and closing the pair of open and close sections is controlled based on detection results of the liquid surface height provided by the liquid surface detection section.

<16> The liquid discharge method according to <14> or <15>, wherein, in the feeding the liquid, the pair of liquid feeding sections feed the liquid stored in one liquid storage section to the liquid retaining section while feeding the liquid from the liquid retaining section to other liquid storage section.

<17> The liquid discharge method according to any one of <14> to <16>, further including controlling at least one selected from the group consisting of the pair of liquid feeding sections and the pair of open and close sections so that the liquid surface height within the liquid retaining section is constant.

<18> The liquid discharge method according to any one of <14> to <17>, with a liquid discharge head, which includes; a plurality of the liquid discharge units; the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections; and the pairs of open and close sections that are same in number as the pairs of liquid storage sections, wherein, in the feeding and the opening and closing, control of the pairs of open and close sections that are same in number as the pairs of liquid feeding sections and the pairs of liquid storage sections selectively feeds the liquid within at least one liquid retaining section in the plurality of the liquid discharge units.

<19> The liquid discharge method according to <18>, wherein, in the feeding, the control is performed so that volume of the liquid to be fed from the at least one liquid retaining section is different from volume of the liquid to be fed from other liquid retaining sections.

<20> The liquid discharge method according to any one of <14> to <19>, further including a volume detection section configured to detect volume of the liquid in the liquid storage section, wherein at least one selected from the group consisting of the pair of liquid feeding sections and the pair of open and close sections is controlled based on detection results of the volume detection section.

The liquid discharge head according to any one of <1> to <11>, the liquid discharge device according to <12>, the dispensing device according to <13>, and the liquid discharge method according to any one of <14> to <20> can solve the aforementioned existing problems and can achieve the object of the present disclosure.

What is claimed is:

1. A liquid discharge head, comprising:

a liquid discharge unit, which comprises a discharge port, a liquid retaining section configured to retain liquid to be discharged from the discharge port, a displacement section configured to discharge the liquid retained within the liquid retaining section from the discharge port, and a liquid surface detection section configured to detect liquid surface height within the liquid retaining section;

a pair of liquid storage sections, which are configured to store the liquid and are each connected to the liquid retaining section in the liquid discharge unit so that the liquid can flow;

a pair of liquid feeding sections that are connected to the pair of liquid storage sections and are configured to feed the liquid between the liquid storage section and the liquid retaining section; and a pair of open and close sections that are each disposed at a flow path between the liquid feeding section and the liquid storage section and are configured to open and close the flow path, wherein opening and closing the pair of open and close sections are controlled based on detection results of the liquid surface height provided by the liquid surface detection section.

2. The liquid discharge head according to claim 1, wherein the liquid is stored in advance in at least one of the pair of liquid storage sections.

3. The liquid discharge head according to claim 1, wherein control is performed so that the liquid is not fed to a side of the liquid feeding section beyond the open and close section.

4. The liquid discharge head according to claim 1, wherein the liquid comprises particles.

5. The liquid discharge head according to claim 1, wherein the pair of liquid feeding sections feed the liquid stored in one liquid storage section to the liquid retaining section while feeding the liquid from the liquid retaining section to other liquid storage section.

6. The liquid discharge head according to claim 1, wherein the liquid discharge head includes:

a plurality of the liquid discharge units;

the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections; and the pairs of open and close sections that are same in number as the pairs of liquid storage sections, wherein control of the pairs of open and close sections that are same in number as the pairs of liquid feeding sections and the pairs of liquid storage sections selectively feeds the liquid within at least one liquid retaining section in the plurality of the liquid discharge units.

7. The liquid discharge head according to claim 6, wherein the control is performed so that volume of the liquid to be fed from the at least one liquid retaining section is different from volume of the liquid to be fed from other liquid retaining sections.

8. A liquid discharge head, comprising:

a liquid discharge unit, which comprises a discharge port, a liquid retaining section configured to retain liquid to be discharged from the discharge port, and a displacement section configured to discharge the liquid retained within the liquid retaining section from the discharge port;

a pair of liquid storage sections, which are configured to store the liquid and are each connected to the liquid retaining section in the liquid discharge unit so that the liquid can flow;

a pair of liquid feeding sections that are connected to the pair of liquid storage sections and are configured to feed the liquid between the liquid storage section and the liquid retaining section;

a pair of open and close sections that are each disposed at a flow path between the liquid feeding section and the liquid storage section and are configured to open and close the flow path; and a controller configured to control at least one selected from the group consisting of the pair of liquid feeding sections and the pair of open and close sections so that liquid surface height within the liquid retaining section is constant.

9. The liquid discharge head according to claim 8, wherein the pair of liquid feeding sections feed the liquid stored in one liquid storage section to the liquid retaining section while feeding the liquid from the liquid retaining section to other liquid storage section.

10. The liquid discharge head according to claim 8, wherein the liquid discharge head comprises:

a plurality of the liquid discharge units;

the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections; and the pairs of open and close sections that are same in number as the pairs of liquid storage sections, wherein control of the pairs of open and close sections that are same in number as the pairs of liquid feeding sections and the pairs of liquid storage sections selectively feeds the liquid within at least one liquid retaining section in the plurality of the liquid discharge units.

11. The liquid discharge head according to claim 8, wherein the control is performed so that volume of the liquid to be fed from the at least one liquid retaining section is different from volume of the liquid to be fed from other liquid retaining sections.

12. The liquid discharge head according to claim 8, further comprising a volume detection section configured to detect volume of the liquid in the liquid storage section, wherein at least one selected from the group consisting of the pair of liquid feeding sections and the pair of open and close sections is controlled based on detection results of the volume detection section.

13. A liquid discharge device comprising the liquid discharge head according to claim 8.

14. A dispensing device comprising:

the liquid discharge device according to claim 13; and a target to be impacted configured to house liquid discharged by the liquid discharge device.

15. A liquid discharge head, comprising:

a liquid discharge unit, which comprises a discharge port, a liquid retaining section configured to retain liquid to be discharged from the discharge port, and a displacement section configured to discharge the liquid retained within the liquid retaining section from the discharge port;

a pair of liquid storage sections, which are configured to store the liquid and are each connected to the liquid retaining section in the liquid discharge unit so that the liquid can flow;

a pair of liquid feeding sections that are connected to the pair of liquid storage sections and are configured to feed the liquid between the liquid storage section and the liquid retaining section; and a pair of open and close sections that are each disposed at a flow path between the liquid feeding section and the liquid storage section and are configured to open and close the flow path;

wherein when liquid volume of the liquid within the liquid retaining section is smaller than a predetermined value, control for feeding the liquid from at least one of the pair of liquid storage sections to the liquid retaining section is performed.

16. The liquid discharge head according to claim 15, wherein the pair of liquid feeding sections feed the liquid stored in one liquid storage section to the liquid retaining section while feeding the liquid from the liquid retaining section to other liquid storage section.

17. The liquid discharge head according to claim 15, wherein the liquid discharge head includes:

a plurality of the liquid discharge units;

the pairs of liquid storage sections that are same in number as the plurality of the liquid discharge units, one liquid storage section in each of the pairs of liquid storage sections being connected to one liquid feeding section in each of the pairs of liquid feeding sections, and other liquid storage section in each of the pairs of liquid storage sections being connected to other liquid feeding section in each of the pairs of liquid feeding sections; and the pairs of open and close sections that are same in number as the pairs of liquid storage sections, wherein control of the pairs of open and close sections that are same in number as the pairs of liquid feeding sections and the pairs of liquid storage sections selectively feeds the liquid within at least one liquid retaining section in the plurality of the liquid discharge units.

18. The liquid discharge head according to claim 17, wherein the control is performed so that volume of the liquid to be fed from the at least one liquid retaining section is different from volume of the liquid to be fed from other liquid retaining sections.

* * * * *